US008123449B2

(12) United States Patent
Porat

(10) Patent No.: US 8,123,449 B2
(45) Date of Patent: Feb. 28, 2012

(54) SINGLE AXIS APPARATUS FOR MANUFACTURING HARD BOOK COVER

(75) Inventor: Tom Porat, Amherst, NH (US)

(73) Assignee: GP2 Technologies, Inc., Bow, NH (US)

( * ) Notice: Subject to any disclaimer, the term of this patent is extended or adjusted under 35 U.S.C. 154(b) by 999 days.

(21) Appl. No.: 11/934,968

(22) Filed: Nov. 5, 2007

(65) Prior Publication Data

US 2009/0116935 A1 May 7, 2009

(51) Int. Cl.

| | |
|---|---|
| ***B42D 1/00*** | (2006.01) |
| ***B42D 5/00*** | (2006.01) |
| ***B42D 3/00*** | (2006.01) |
| ***B42D 15/00*** | (2006.01) |
| ***B42C 9/00*** | (2006.01) |
| ***B42C 7/00*** | (2006.01) |
| ***B42C 13/00*** | (2006.01) |
| ***B42C 11/00*** | (2006.01) |
| ***B42C 11/02*** | (2006.01) |

(52) U.S. Cl. ..... 412/17; 281/15.1; 281/29; 281/36; 281/37; 283/63.1; 283/64; 412/1; 412/3; 412/9; 412/11; 412/14; 412/18; 412/19

(58) Field of Classification Search ..... 281/15.1, 281/29, 36, 37, 51; 283/63.1, 64, 117; 412/1, 412/3, 9, 11, 14, 17, 18, 19
See application file for complete search history.

(56) References Cited

U.S. PATENT DOCUMENTS

| | | | |
|---|---|---|---|
| 2,556,787 | A | 6/1951 | Bach et al. |
| 2,769,187 | A | 11/1956 | D'Huy |
| 4,111,739 | A | 9/1978 | De Bin et al. |
| 4,889,461 | A | 12/1989 | Kampen et al. |
| 4,975,010 | A | 12/1990 | Karolyi |
| 5,230,687 | A | 7/1993 | Lombardo et al. |
| 5,259,825 | A | 11/1993 | De Angelis et al. |
| 5,364,215 | A | 11/1994 | Snellman et al. |
| 5,413,446 | A | 5/1995 | Rathert et al. |
| 5,827,033 | A | 10/1998 | Feldman |
| 6,193,458 | B1 | 2/2001 | Marsh |
| 6,338,603 | B1 | 1/2002 | Cerruti |
| 6,352,252 | B1 | 3/2002 | Schmucker et al. |
| 6,379,094 | B1 | 4/2002 | Porat |
| 6,447,230 | B1 | 9/2002 | Takai et al. |
| 6,843,473 | B2 | 1/2005 | Bohn et al. |

(Continued)

FOREIGN PATENT DOCUMENTS

| | | |
|---|---|---|
| CA | 2087657 | 7/1993 |

(Continued)

OTHER PUBLICATIONS

US Office Action dated Jul. 25, 2007 issued in U.S. Appl. No. 11/078,860.

(Continued)

*Primary Examiner* — Dana Ross
*Assistant Examiner* — Justin Lewis
(74) *Attorney, Agent, or Firm* — Finch & Maloney PLLC

(57) ABSTRACT

An apparatus for producing hard book cases (covers) can make cases including tucked and folded corners. The apparatus can track the progress of the book case throughout the assembly process and can accurately align the unfinished assembly with the tucking and folding devices of the apparatus. Short runs of different sized book cases may be quickly and efficiently manufactured on a single apparatus.

16 Claims, 22 Drawing Sheets

U.S. PATENT DOCUMENTS

| | | | | |
|---|---|---|---|---|
| 7,210,887 | B2 | 5/2007 | Engert et al. | |
| 2005/0180843 | A1 * | 8/2005 | Porat | 412/19 |
| 2006/0210378 | A1 | 9/2006 | Geldmeier et al. | |

FOREIGN PATENT DOCUMENTS

| | | | |
|---|---|---|---|
| EP | 0461083 | | 12/1991 |
| GB | 1380537 | A * | 1/1975 |

OTHER PUBLICATIONS

US Final Office Action dated Jan. 3, 2008 issued in U.S. Appl. No. 11/078,860.

* cited by examiner

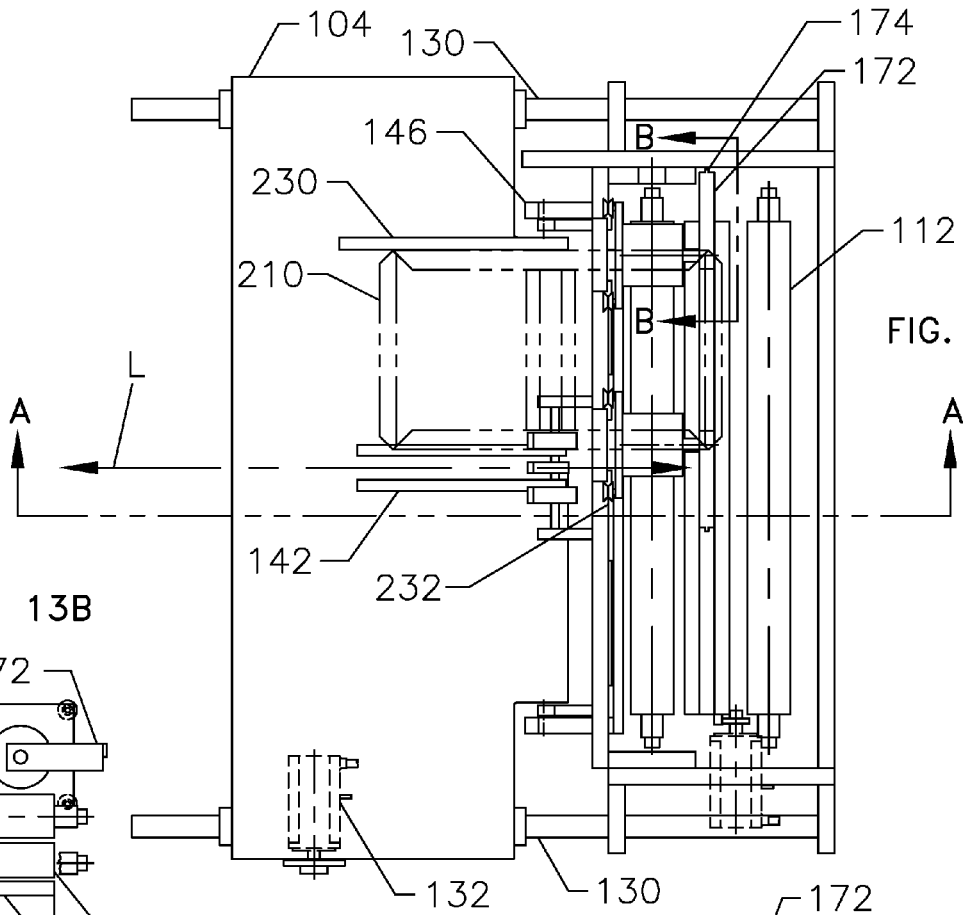
FIG. 13
FIG. 13B
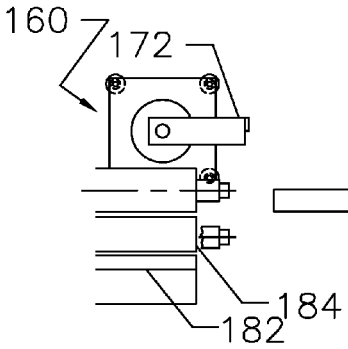
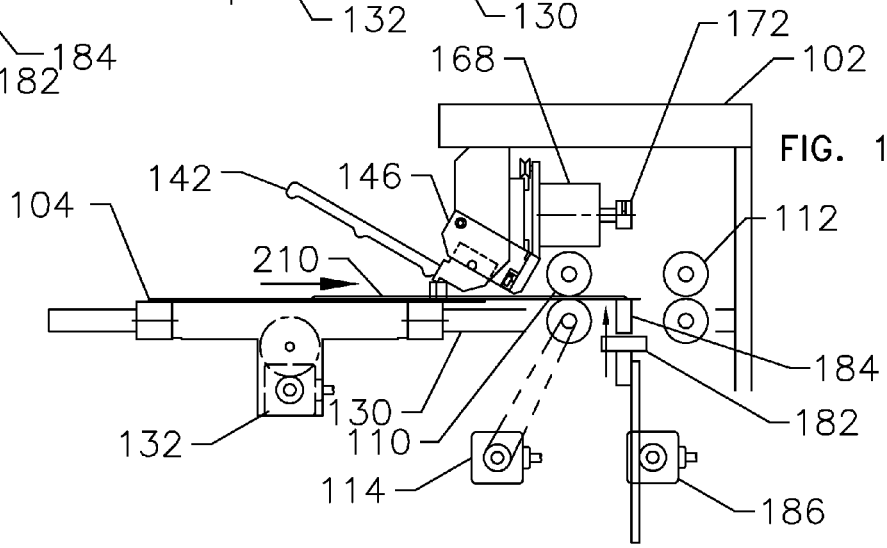
FIG. 13A

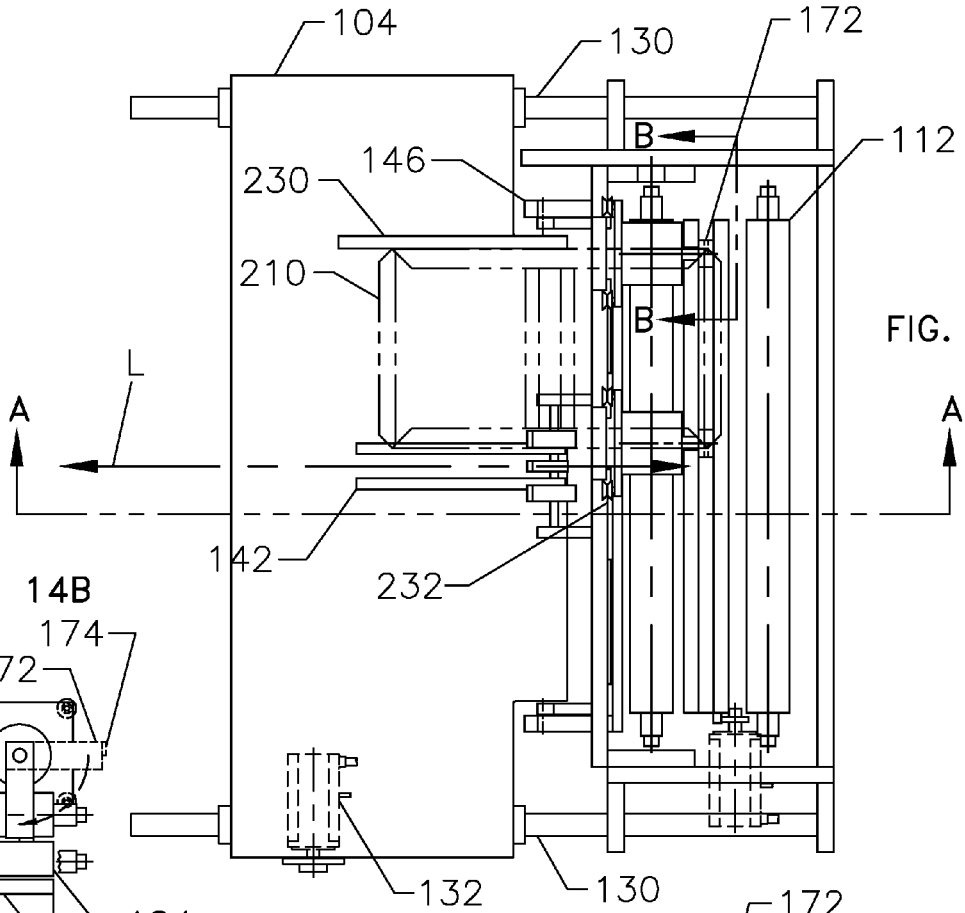
FIG. 14
FIG. 14B
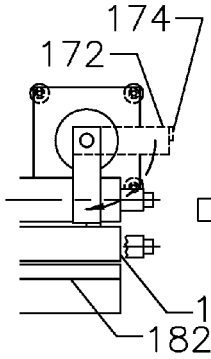
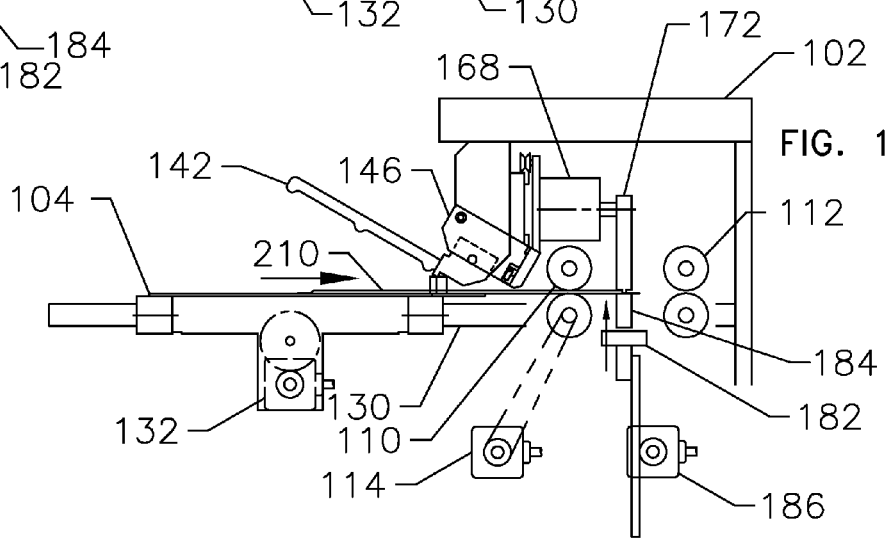
FIG. 14A

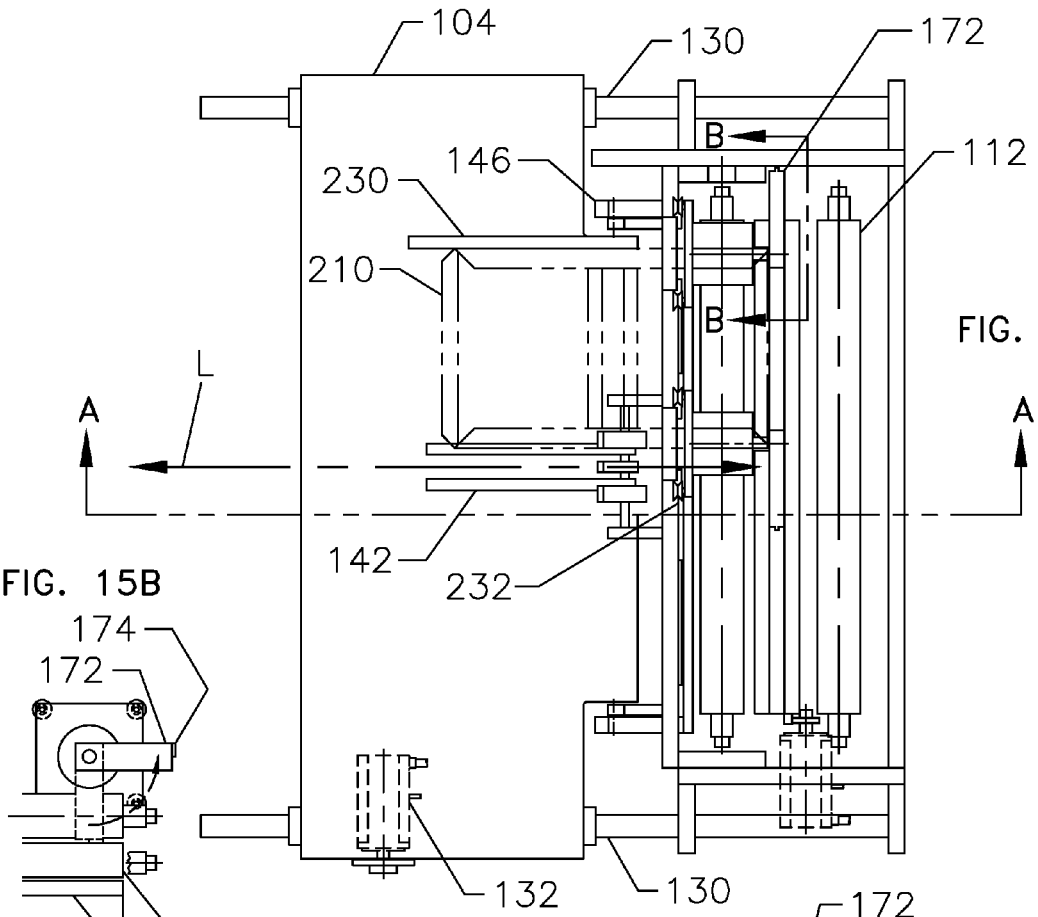
FIG. 15
FIG. 15B
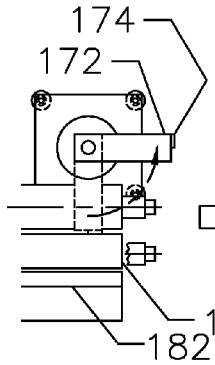
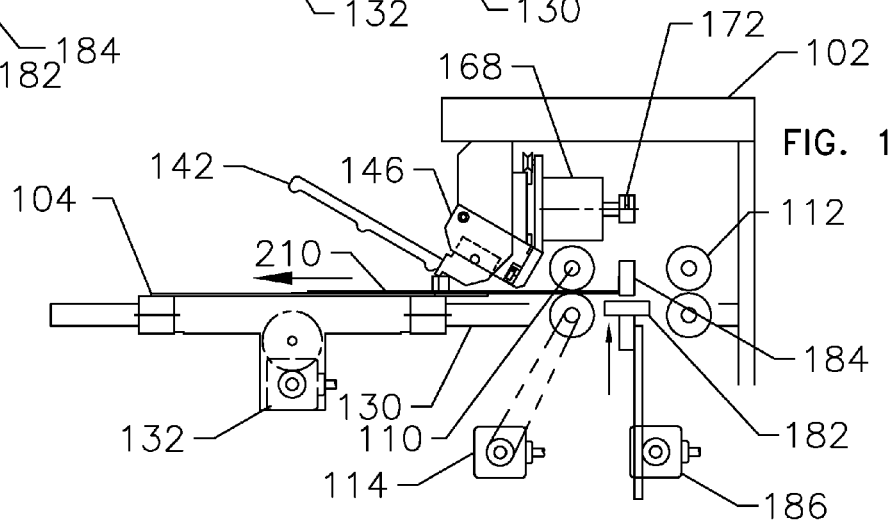
FIG. 15A

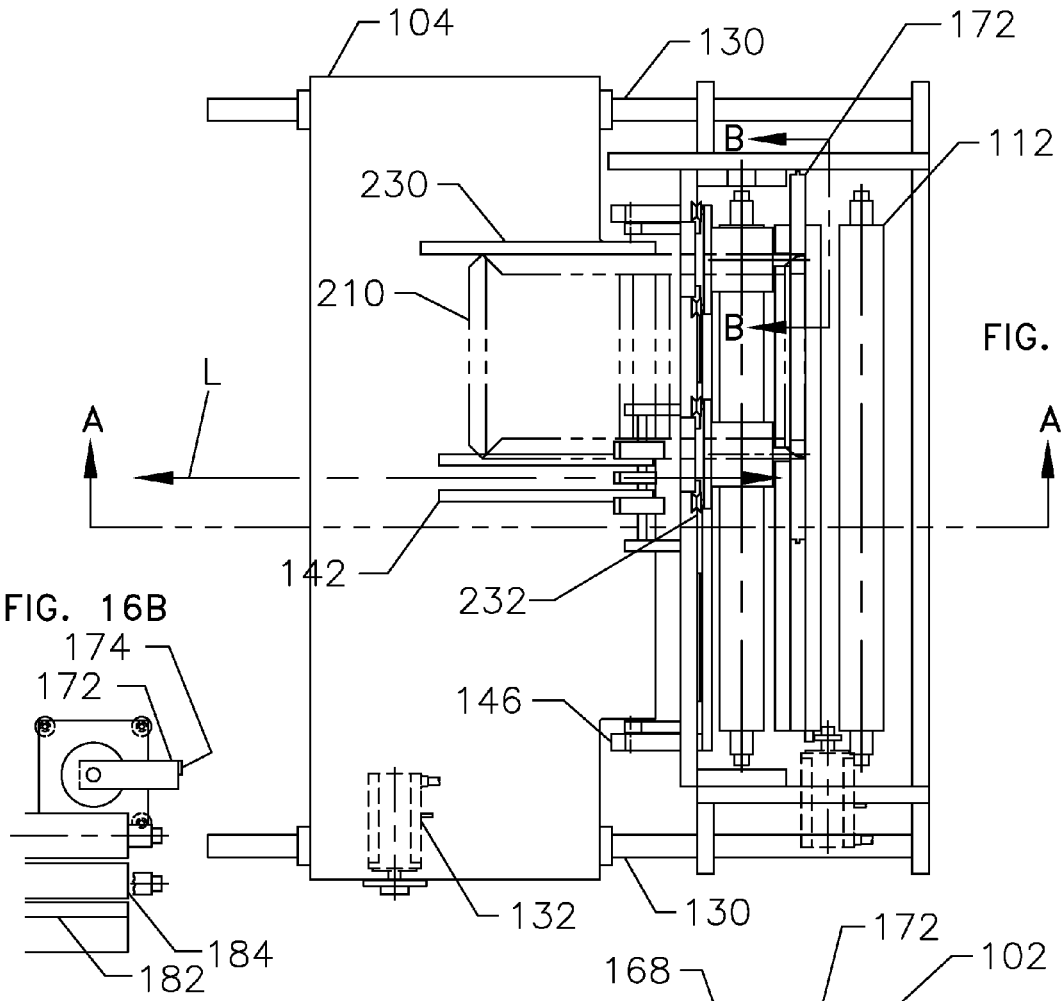
FIG. 16
FIG. 16B
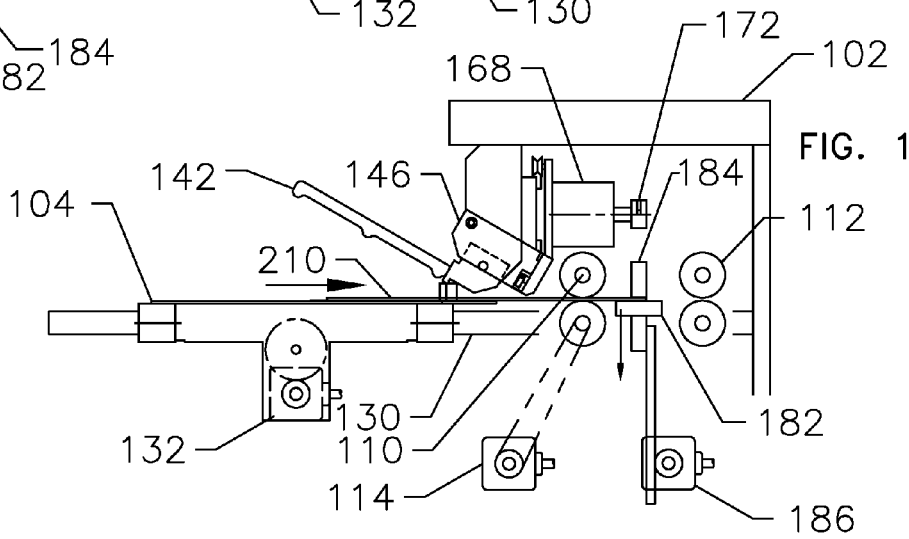
FIG. 16A

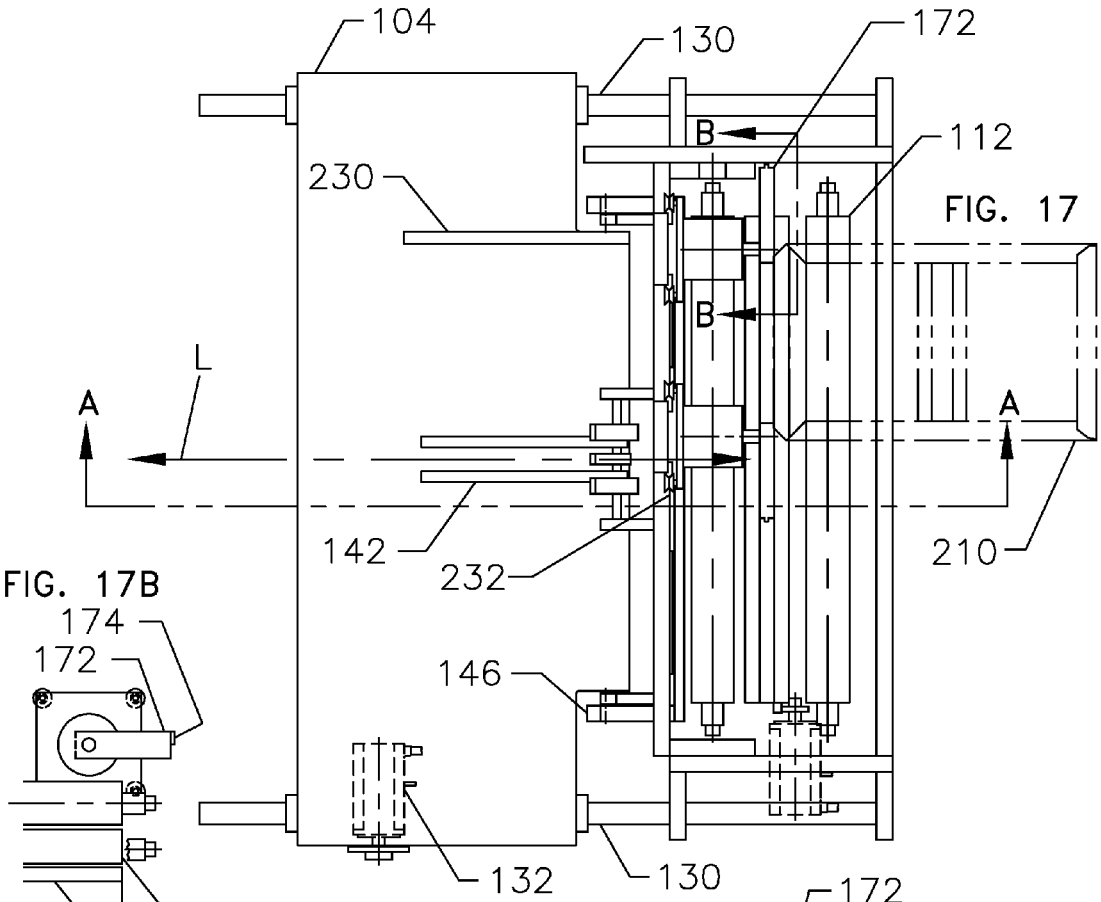
FIG. 17
FIG. 17B
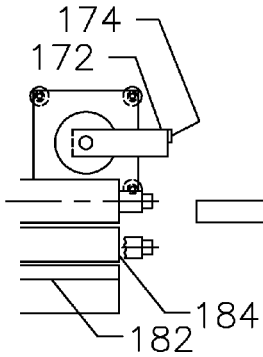
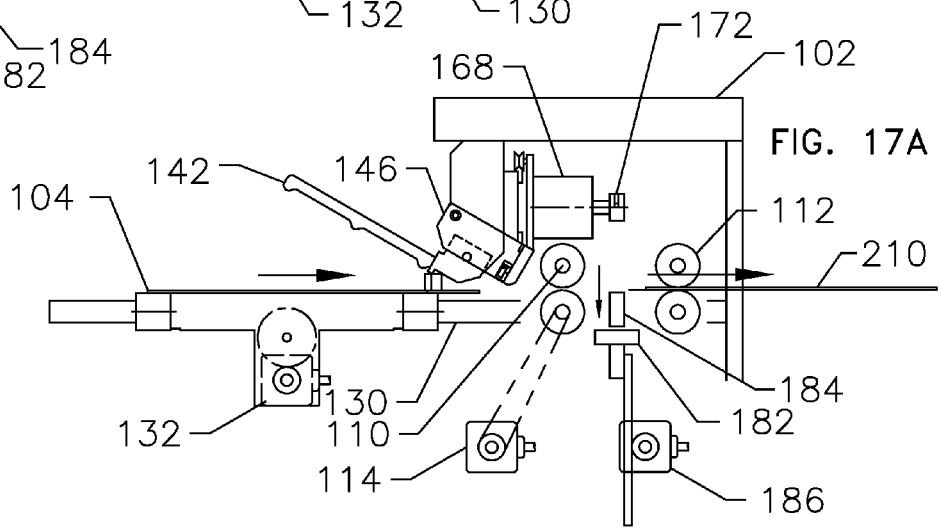
FIG. 17A 104
130
172
112
B
230
B
L
A
A
142
232
210
146
132
130

174
172
184
182

168
172
102
142
146
104
112
210
130
110
114
132
184
182
186

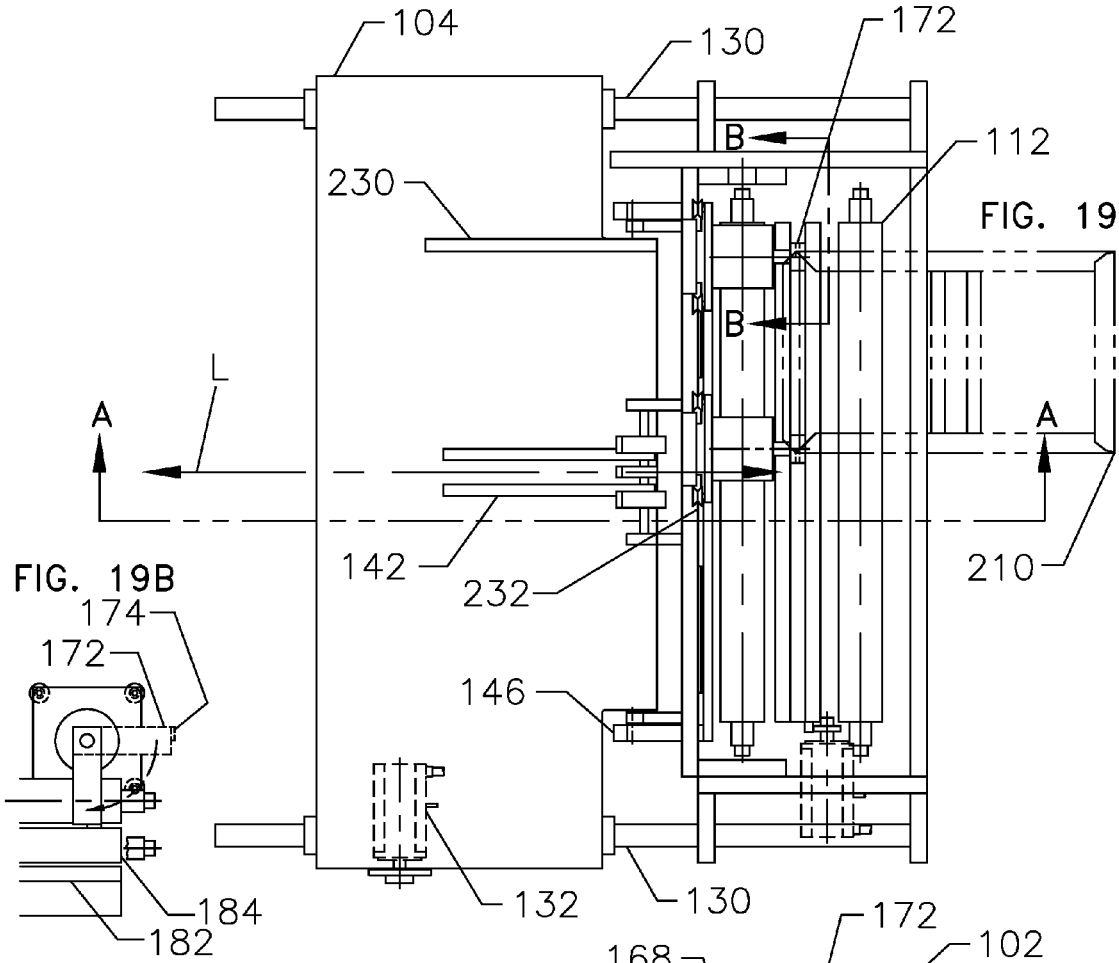
FIG. 19
FIG. 19B
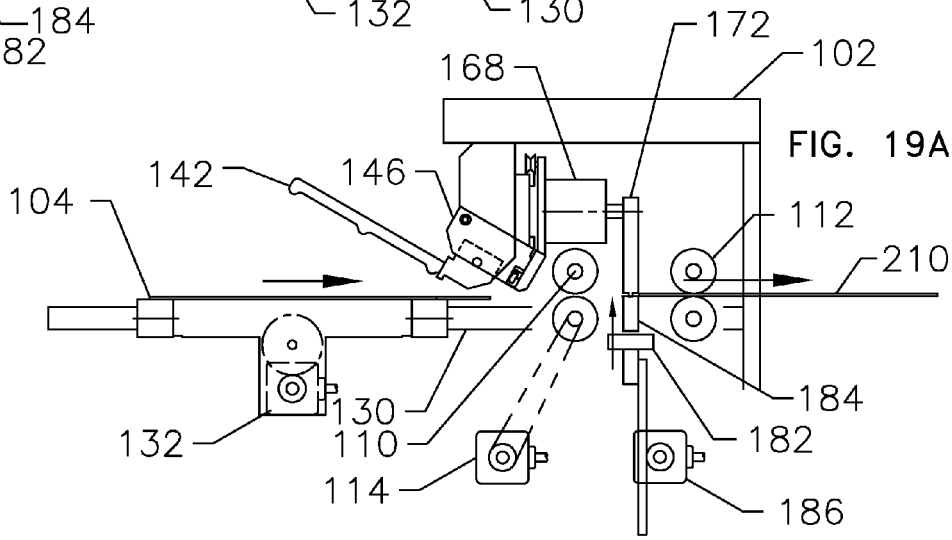
FIG. 19A

B
A
B
A
210
ASSY CORNER PRE-TUCK
218
212
210
160
172
168
164

184
182
186
174
172

184
182
TOP VIEW
172
210
212

174
212
172

182
TUCKED
210
212

SINGLE AXIS APPARATUS FOR MANUFACTURING HARD BOOK COVER

BACKGROUND

1. Field of Invention

The invention relates to methods and apparatuses for manufacturing hard book cases and, in particular, to machines for tucking and folding book cases.

2. Discussion of Related Art

Cases for hard cover books are typically produced by printing a rectangular sheet of paper, cloth or leather, known as the cover material, and subsequently gluing the cover material to a pair of panels and a spine. The panels and spine (the rigid component) provide rigidity for the case, with one of the panels forming the front of the finished book and the second forming the back. The spine provides rigidity to the spine portion of the book. The spine and panels are typically made of chipboard or other stiff material. In some cases, the spine is of a more flexible material. A space is usually left between the spine and the panels so that the cover may be opened and closed in hinge-like fashion. Manufacturing techniques typically include a step of placing the panels and spine on a glued cover material and then folding the edges of the cover material up and onto the inside edges of the panels (and the ends of the spine). Together, the spine, panels, and cover material are known as a hard book cover assembly or a hard book case.

In an unfinished hard book case, the cover material is sized and placed to extend outwardly past the periphery of the spine and the panels to be later folded back over the edges of the spine and panels to produce an attractive cover. The overlapping edges of the cover material are glued on the inside of the panels and spine, and these edges are generally hidden later in the book making process when paper or other material is glued over the interior of the hard book cover in a manner that overlaps, and thus hides, the edge of the cover material from a reader.

There are two main types of corner folding used to make hard cover books. One type of corner fold is known as an "edition corner" (also cut corner, standard corner, tucked corner or square corner). The second type is known as a "library corner."

For edition corners, the cover material is typically cut into a rectangular shape that is about 1½ inches larger in each of the X and Y dimension than the desired finished (open and flat) book cover (case) size. When the cover material is affixed to the rigid components of the hard book case (for example, 2 panels and 1 spine) there typically is a cover material overhang of about ¾ inch around the outer edges of the rigid components. To remove excess cover material, the corners of the cover material typically are trimmed prior to affixing the cover material to the panels and spine. By eliminating this corner material, multiple layers of bunched cover material do not develop at the corners of the finished hard book case.

Cover material is often cut in a stack so that multiple pieces can be cut simultaneously in preparation for a run of many copies of the same hard book case. This is typically performed at a cutting station separate from the hard book case making apparatus.

An identically sized triangular piece is cut from each of the four corners as the spine and panel will be placed square and centered on the cover material. Preferably, these cuts are made at a 45 degree angle to the longitudinal edges of the panels leaving an amount of cover material extending outwardly from each of the outer four corners (in a direction bisecting the 90 degree corner of the panel) of each panel a distance that will be equivalent to approximately 2 times the thickness of the panel material in the finished product.

After the corners have been cut and an adhesive has been applied to the cover material, the spine and panels are placed on the cover material with the outer edges of the panels in parallel with the adjacent (closest) outer edges of the cover material. Each edge can be longitudinally folded over the panel to produce an edition corner that has only a small area of glued, overlapping cover material on the inside surface of each panel at the corner.

For a library corner, the corner of the cover material is not cut off, but is instead folded back over the corner of the panel prior to folding back the longitudinal edges of the cover material. This results in an extra layer of cover material on the inside of the panel.

Due to the ease with which books and manuscripts can be printed using modern technologies, such as digital printing, a need has developed for hard cover book making machines that can produce small numbers (tens or hundreds, for example) of hard covers for authors and publishers desiring hard covers for their works. Furthermore, as digital printing becomes available in numerous outlets, including copy shops, work places, internet sites and even homes, there has developed a need for hard cover book making machines that can be operated in these areas. In addition to being inexpensive, it may be desired that the book cover making machines require as small an amount of space as possible, are easy to set up, and require minimal skill and training for operation. Space considerations may be of particular interest in those locations with higher real estate expense than traditional publishing companies.

While apparatuses exist that can quickly fold edges of cover material over the rigid panels it is much more difficult to provide tucked corners on short run machines that are designed to produce a variety of different sized cases.

SUMMARY OF INVENTION

The subject matter of this application may involve, in some cases, interrelated products, alternative solutions to a particular problem, and/or a plurality of different uses of a single system or article.

In one aspect a method of forming a case for a book using a case making machine is provided, the method comprising placing a cover material and a pair of rigid panels together to produce an unfinished case, determining at least one outer dimension of the pair of rigid panels, transporting the assembly along a first axis to a first indexed location, stopping the assembly at the first indexed location where at least one edge of the cover material is folded over a corresponding edge of a rigid panel, feeding the assembly along the first axis to a second indexed location for corner tucking, stopping the assembly at the second indexed location, tucking at least a first corner of the cover material, and folding a second edge of the cover material over a corresponding edge of a rigid panel to form a finished corner and a finished case.

In another aspect, an apparatus for producing a hard case for a book is provided, the apparatus comprising a feed table mounted to a framework, the feed table slideable along at least a first axis, a drive system for advancing and retracting the hard book case, two pairs of press rollers mounted to the framework and positioned transversely to the first axis, a corner tucker mounted to the framework and constructed and arranged to tuck one or more corners when the one or more corners are located between the two pairs of press rollers, and a controller in communication with the corner tucker and with the drive system wherein the controller can position the hard case in relation to the corner tucker based on at least one dimension of the hard case.

In another aspect, a method of forming a case for a book using a case making machine is provided, the method comprising placing a cover material and a pair of rigid panels together to form an unfinished case, determining at least one outer dimension of the pair of rigid panels, transporting the assembly along a first axis to a first location where a leading edge of the pair of rigid panels is aligned with a folding bar, stopping the transport of the assembly at the first location, folding one edge of the cover material over a corresponding edge of a rigid panel, transporting the assembly along the first axis to a second location where a trailing edge of the pair of rigid panels is aligned with a folding bar, stopping the transport of the cover material at the second location, and folding a second edge of the cover material over the trailing edge of the pair of rigid panels.

In another aspect, an apparatus for producing cases for hard cover books is provided, the apparatus comprising a feed table for transporting an unfinished hard book case along a first horizontal axis, a swing gate including a forward stop for positioning the leading edge of a case panel, a pair of press rolls for transporting the case along the first horizontal axis, a fold bar constructed and arranged to fold both a leading edge and a trailing edge of the case, and a controller in communication with the feed table, the press rolls and the fold bar wherein the controller can track the position of the assembly along the first horizontal axis.

BRIEF DESCRIPTION OF DRAWINGS

In the drawings,

FIGS. 13, 13A and 13B are, respectively, a schematic plan view, a side view along line A-A, and a side view along line B-B, showing the unfinished case assembly at a later stage of production;

FIGS. 14, 14A and 14B are, respectively, a schematic plan view, a side view along line A-A, and a side view along line B-B, showing the unfinished case assembly at a later stage of production;

FIGS. 15, 15A and 15B are, respectively, a schematic plan view, a side view along line A-A, and a side view along line B-B, showing the unfinished case assembly at a later stage of production;

FIGS. 16, 16A and 16B are, respectively, a schematic plan view, a side view along line A-A, and a side view along line B-B, showing the unfinished case assembly at a later stage of production;

FIGS. 17, 17A and 17B are, respectively, a schematic plan view, a side view along line A-A, and a side view along line B-B, showing the unfinished case assembly at a later stage of production;

FIGS. 19, 19A and 19B are, respectively, a schematic plan view, a side view along line A-A, and a side view along line B-B, showing the unfinished case assembly at a later stage of production;

DETAILED DESCRIPTION

Figure 1:
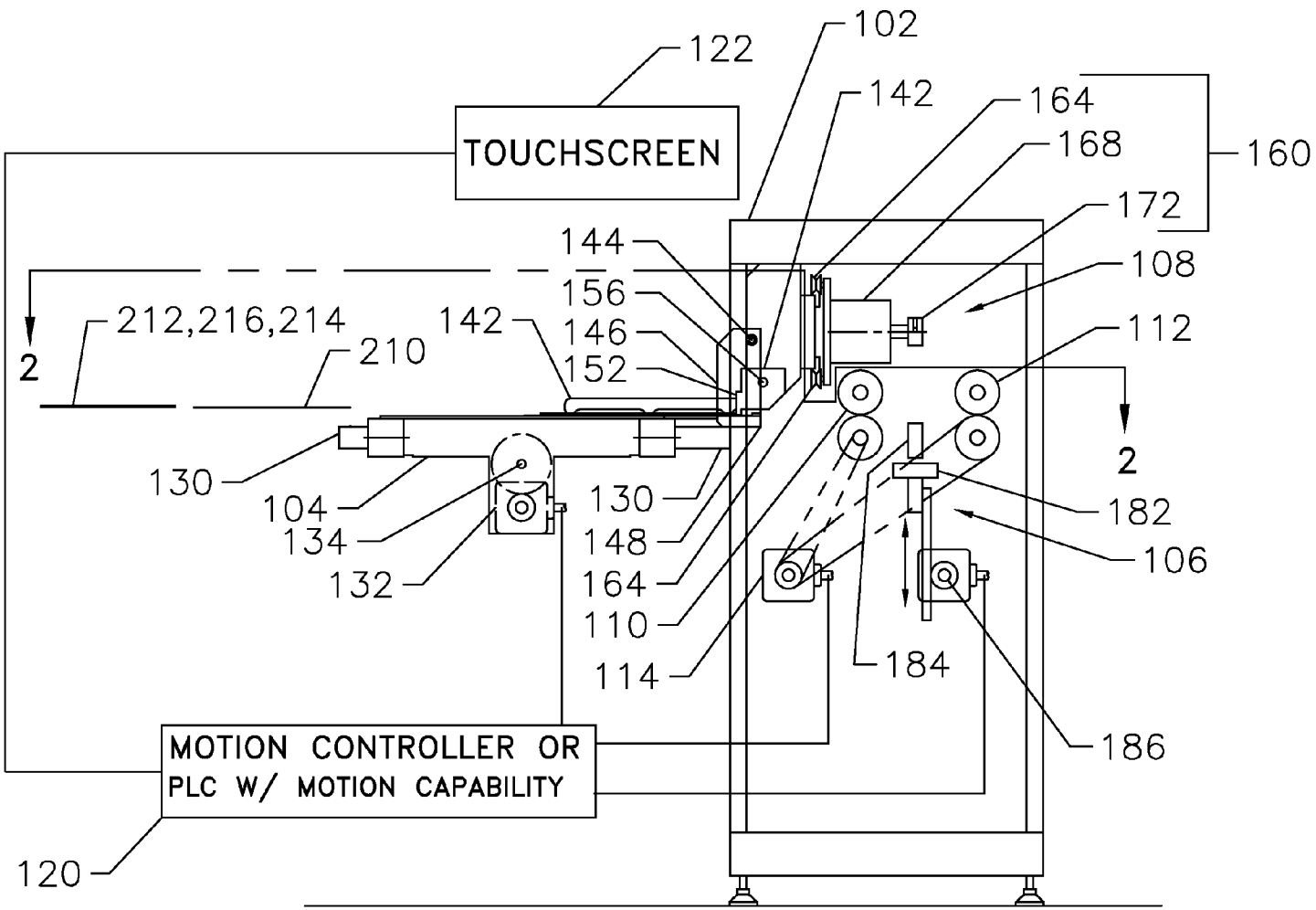
FIG. 1 is a schematic side view of one embodiment of an apparatus of the invention.

When cover material is attached to a rigid panel to produce a hard cover, the corners of the material may be folded and "tucked" to produce a pleasing, functional cover. Tucking is known to those skilled in the art and typically occurs after a first edge of cover material is folded and before an adjoining edge is folded. Tucking involves flattening the angled portion of the folded cover material that extends beyond the panel of the folded edge so that the subsequent fold results in a tighter, neater corner. In production, boards that provide stiffness to the back cover, front cover, and spine are typically first laid in position on a piece of cover material (typically printed on one side and glued on the other). Opposing edges of the cover material may then be folded over and secured to the board. Then, before folding over the remaining two opposing edges, the cover material may be tucked to provide a cleaner, more professional looking corner when the final edges are folded over to complete the case. Corner folding and tucking is described in more detail in U.S. Pat. No. 6,379,094, titled APPARATUS FOR TUCKING HARD BOOK COVERS and in U.S. patent application Ser. No. 11/078,860, titled APPARATUS AND METHOD FOR MANUFACTURING HARD BOOK COVER ASSEMBLIES, both of which are hereby incorporated herein by reference.

Corner tucking of cover material may require more precision than does the folding of cover material onto a rigid panel. In addition, many edge folding techniques may not tightly wrap the cover material against the edge of the panel and can leave an air space between the cover material and the edge of the panel. This may occur, for example, due to a lack of force pushing the cover material against the edge of the panel as it is wrapped around the panel end. For instance, edges may be folded onto a panel by feeding the unfinished book case past a counter rotating brush bar such as described in U.S. Pat. No. 5,230,687. For this brush bar type of folding, the position of the case during the manufacturing process may not need to be tracked, however the edge is not folded tightly over the panel and different sized covers may be difficult to produce. Corner tucking typically requires that a small piece of cover material be compressed onto an adjacent piece of cover material and against the edge of the rigid panel. If the positioning of the tucking device in relation to the unfinished case is not precise enough, a proper tuck may not be completed. A tightly folded edge may also require more precision positioning so that a force can be applied to the edge of the panel.

In one aspect, an apparatus is provided that can track the movement of an unfinished cover assembly (unfinished case) through the production process. By tracking the movement of the case, the position of one or more edges of the assembly can be determined at all times during the process. By knowing where an edge of the assembly is and by being able to position that edge, the edge can be precisely placed for folding and/or corner tucking. Either the edge can be moved to the tucking or folding device and/or the tucking or folding device can be moved to the edge. The relative position of the trailing edge and/or the leading edge in reference to the folding device can be determined and the relative position of the corners can be determined in reference to the corner tucking device.

In some embodiments, a properly positioned leading or trailing edge of an unfinished assembly can be achieved by knowing at least one dimension of the finished assembly (length or width for example) and then by advancing the unfinished assembly a corresponding distance from a fixed starting point to a folding and/or corner tucking device. A leading edge can be positioned properly for folding or corner tucking by, for example, positioning the leading edge at a known starting location and then advancing it a predetermined distance to the tucking device. The trailing edge can be positioned accurately, for example, by knowing its initial starting position or by knowing the starting position of the leading edge and knowing the distance between the leading and trailing edges. For instance, if the width of the finished assembly (essentially identical to the distance from the outside edge of one panel to the opposing outside edge of the other panel) is 16 inches, then after tucking the leading edge, the assembly can be advanced 16 inches to tuck the trailing edge. Thus, the combination of awareness of the width of the case and the ability to track the assembly's movement through the manufacturing process can provide for precise positioning for corner tucking.

In one set of embodiments cover material (typically with the corners cut) and panels may be positioned using stops at the top and/or sides of the feed table. The stops may be attached to the feed table or may be separately associated with the framework of the apparatus. Different stops or guides may be used for proper registration of the cover material and the panels. The glued cover material may be placed on the feed table first and followed by placement of the panels on the glued cover material to form an unfinished case. The feed table may be any device that can function by advancing the unfinished assembly and by indexing the position of the unfinished assembly so that the unfinished assembly can be accurately positioned for downstream operations. The unfinished assembly can be advanced by the feed table and handed off to a second part of the drive mechanism such as a pair of press rollers. The procedure may be initiated by a controller that can coordinate the hand off between the feed table and the press rollers and keep track of the position of the unfinished assembly throughout the process. The leading edge may be advanced to a folding bar that folds the leading edge of the cover material back over the leading edge of the panels. The folding bar may also press the cover material into the edge of the rigid panel as the material is folded over the panel. The assembly may then be advanced to a point where the trailing edge of the cover material is aligned with a folding device and the same or similar steps may be repeated to fold the trailing edge. The unfinished assembly may then be returned to the feed table where it may be rotated 90 degrees by, for example, the operator of the machine. The rotated assembly may then be re-fed to the rollers so that the two unfinished edges are completed in a manner similar to that used with the first two edges. The rotated assembly may be aligned against a front and/or side stop to help index the initial position of the rotated assembly. Before each of the last two edges is folded, the cover material may be corner tucked. To do so, the apparatus can track the progress of the assembly along the drive system and, in combination with a determined length of the assembly (the width that has been rotated 90 degrees), can align each of the remaining edges in the proper position for corner tucking. After each corner along an unfolded edge has been tucked, the edge can be folded over and pressed to produce finished edges and corners.

One or more outer dimensions of a finished assembly may be determined in a number of ways. In most cases the outer dimensions of a finished assembly are essentially the same as the outer dimensions of the pair of rigid panels when they are laid in position on the cover material. Although the wrapping of the cover material around the panel edges may add to this dimension, the amount is usually negligible or can be compensated for. Typically, the initial position of the leading edge is known because it can be placed against a stop at a fixed location. The trailing edge, however, may be more difficult to locate as cases of different sizes may be produced by the same apparatus. In some embodiments, the width and/or length of the assembly can be measured and input to the controller by the operator through a user interface. In other embodiments a measuring device may be used to measure one or more of these dimensions and the measuring device may communicate these dimensions to the controller. Such a device may be, for example, a pair of measuring arms that can be swung into contact with the edges of the panels. Each measuring arm may be connected to a rotary encoder that is in communication with a controller. In other embodiments, a photo cell may be used to detect when the leading edge of the cover material passes by and when the trailing edge passes by. While this photo cell method may provide the dimensions of the cover material and not the dimensions of the finished assembly, the amount of overhang may be known and can be subtracted to provide the dimension of the finished assembly.

In another embodiment, one or more components of the drive mechanism may be monitored to determine one or more dimensions of the unfinished assembly. For instance, a servo motor can be monitored to reveal a positional error or an increase in motor torque when an edge of the unfinished assembly first encounters an obstacle such as a folding bar. As an unfinished assembly contacts a folding bar or other obstacle, the advancement of the assembly will be slowed due to the resistance of the obstacle. This slow down may result in a positional error as the assembly will not be advanced to its expected position. This positional error can be monitored and can be used to determine the length and/or width of the unfinished assembly. A positional error may initiate an increase in motor torque in order to compensate for the slow down in the advancement of the assembly. The resulting increase in motor torque can be detected, and because the assembly can be tracked throughout its transport, the position of a panel edge and therefore a dimension of the unfinished assembly can be determined. In some embodiments, the assembly is moved in reverse to determine the position of the trailing edge. Once a dimension is determined by any means, it may be retained for any additional runs of the same case. A positional error or torque change may detect the edge of the rigid panel rather than an edge of the cover material as the cover material may not provide sufficient resistance to bending when it encounters an obstacle. In many cases this is preferred as the dimensions of the rigid panels are typically used to determine where to fold and/or tuck the cover material.

Another method of determining the dimensions of a finished or unfinished case includes detecting the position of the edges of the cover material of the unfinished case. The location of the edges of the cover material can be accurately determined using optical detectors. For example, a vertical beam of light can be interrupted as a leading edge passes through the beam and uninterrupted after a trailing edge passes by the beam. By knowing the amount of travel during the period of light beam interruption, the distance from the leading edge of the cover material to the trailing edge of the cover material can be calculated. This distance, however, varies from the corresponding dimension of the finished assembly by the amount equal to the sum of the amount of cover material overhang on the leading edge of the unfinished assembly and the amount of cover material overhang on the trailing edge of the unfinished assembly. If the amount of overhang from the edge of the panel to the edge of the cover material is known, this quantity can be subtracted from the detected dimension to arrive at the panel dimension. If the position of the panel can be tracked through the construction process, then the calculated panel dimension can be used to position the edges of the panels accurately and precisely for tucking and/or folding.

Another technique for determining dimensions includes the use of distance measuring laser sensors that may be capable of measuring the 'step' of the panel edge that rises above the cover material. These sensors, such as the OBDM 12P6910/S35A difference diffuse sensor available from Baumer Electric Ltd., Southington, Conn., may be capable of accurately measuring the length and/or width of the panels mounted on cover material. By analyzing the sensor's analog output, an algorithm can be used to distinguish the panel's edge while ignoring the edge of the cover material. For instance, the sensor may detect the step up to a leading edge and then detect the step down at the trailing edge. By knowing the rate of transport and amount of time between these two events, the length and/or width of the panel may be accurately calculated.

Often, there may be variation in the amount of cover material overhang that exists between the edge of a panel and the edge of the cover material. In these cases, and various others, a combination of techniques may be useful in positioning the unfinished assembly for folding and/or tucking. For instance, an optical detection technique can be used to determine the dimensions of the cover material and to provide an approximate dimension for the finished case. This may provide, within a few millimeters for example, an estimation of the position of the edges of the rigid panels. In operation, the cover material dimension may be used to advance the unfinished assembly at full production speed to a position that is close, but short of, contacting the rigid panel with the fold bar. At this point, the speed of advancement can be slowed and the error position or torque detection method can be implemented. When a rigid edge touches the fold bar, the change in error position or torque is detected and the total distance traveled (and thus the dimension of the unfinished assembly) can be calculated. In this manner, the unfinished assembly is not jammed against the fold bar before the machine is given time to react to the change in error position or torque. Once the dimensions of a particular case are determined, identical copies of the same case can be run at full speed as the dimensions are known and can be stored on board the controller. When a differently dimensioned assembly is to be produced, one or more of the detection methods may be repeated to determine one or more dimensions of the new assembly.

Different sized cases may be made on a single apparatus, and the operator may be able to switch from one size to another size without changing components or without making adjustments to the apparatus. In some cases a tucking assembly may be manually aligned by the operator but in other embodiments this may be done automatically through the controller. The operator may simply place the cover material and rigid component(s) on the feed table, and the apparatus can detect the size of the unfinished assembly and complete the construction of the case using this determination. In other embodiments the operator may need to only supply measurements to the controller. For example, the operator may input actual dimensions to a touch screen or other user interface or may move an arm on a rotary measuring device to contact an edge of the rigid panel. The operator need not be concerned with the order in which different sized cases are made. Rigid panels as small as 3.75 inches by 3.75 inches square may be used, and the same apparatus may use panels up to as large as 18 inches by 18 inches. This would typically mean finished case sizes ranging from 3.75 by 8 inches up to 18 inches by 36 inches.

Figure 2:
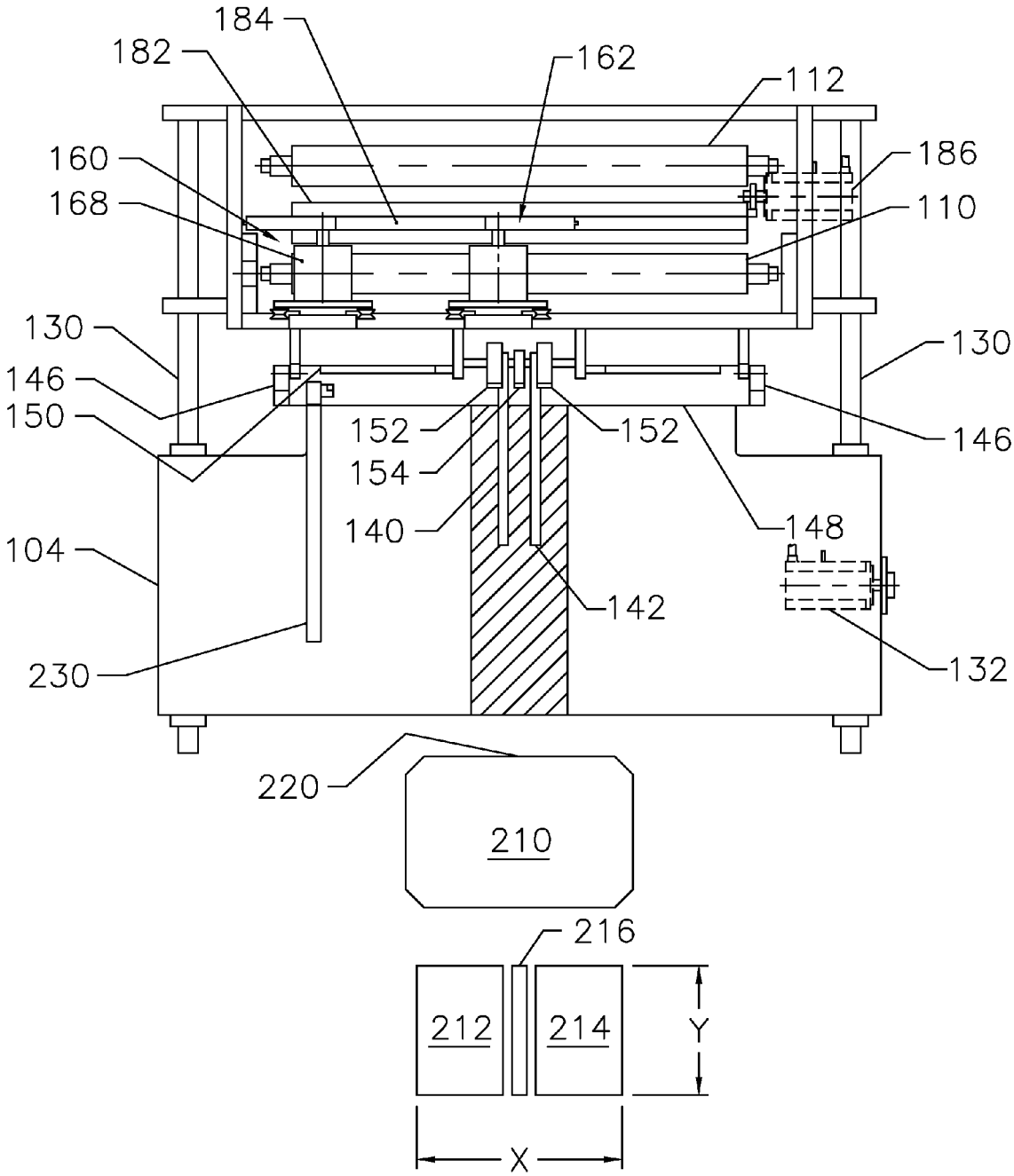
FIG. 2 is a schematic plan view along line 2-2 of FIG. 1.

One embodiment is illustrated in FIGS. 1 through 21. FIG. 1 provides a cross-sectional view of an apparatus for producing hard book cases. FIG. 2 provides a plan view along line 2-2 of FIG. 1.

Framework 102 can be used to support the components of the apparatus including feed table 104, folding device 106, tucking device 108 and press roll pairs 110 and 112. Feed table 104 and press roll pairs 110 and 112 together form a drive mechanism. For transporting the assembly, controller 120 may be used to control all axes of motion and may include a user interface such as touch screen 122.

Feed table 104 is supported by shaft(s) 130 and is driven by servo motor 132 which is connected to gear 134 that interfaces with a rack (not shown) underneath feed table 104 in the direction of axis L, the direction of travel. Thus, activation of servo motor 132 results in lateral motion of feed table 104.

Gauge blocks 140 and 142 can help provide for proper positioning of panels. The gauge blocks can be adjusted laterally to accommodate zero, one, two or more spines of different widths. Gauge block lips 152 and 154 provide a backstop for aid in aligning the top edge of spines and panels when they are laid on the feed table. Gauge blocks may be sized so that cover material slips under the blocks while rigid panels are retained by, for example, lips 152 and 154. The gauge blocks may be rotated upwardly around shaft 156 to allow advancement of the unfinished assembly to press rollers 110.

Swing gate 148 may extend the full width of the assembly area and can include raised lip 150 for aligning and/or retaining cover material when it is laid on feed table 104. As shown, swing gate 148 is level with feed table 104. Swing gate 148 is supported on the framework by swing gate brackets 146 that can pivot around shaft 144. Pivoting allows swing gate 148 to be moved out of the way to allow for the advancement of the hard case on the feed table to press rolls 110.

The apparatus may include one or more corner tucking assemblies. FIGS. 1 and 2 show two corner tucking assemblies 160 that each includes lateral support wheels 164, pneumatic rotary actuator 168 and rotary tuck arms 172. Upper and lower support wheels 164 secure the tucking assembly to the framework and allow for lateral adjustment of the positioning of the tuck assemblies. Each tuck assembly may be fixed in location using a locking device that can be unlocked and locked by the operator, or the operation may be automated. Lateral movement of the tuck assembly may allow the apparatus to accept hard book cases of different heights. When actuated, rotary tuck arms 172 are rotated downwardly to tuck corners of cover material prior to final folding.

Folding device 106 includes base 182 and bar 184. Base 182 and bar 184 may move together or independently. Motor 186 can be used to raise and lower the folding device through a gear and rack system. A gap between base 182 and bar 184 may be sized to allow the passage of an unfinished assembly there between. The gap may be raised to a position where it is level with the pathway of the unfinished assembly. This pathway typically passes through the point of contact of a first pair of rollers 110 and a second pair of rollers 112.

Press roller pairs 110 and 112 may be driven together or independently. As shown in the figures, each pair of rollers is driven by motor 114. Each roller may be comprised of a steel core, a urethane layer and a PTFE coating. The rollers in each pair may be biased toward each other by, for example, springs or pneumatic cylinders. As an unfinished hard book case passes between the rollers, the rollers separate enough to allow passage of the assembly but retain enough pressure between them to securely press the cover material against the rigid panel. Motor 114 may be a servo motor so that controller 120 can control exactly how far the assembly is carried by the press rolls. The direction of travel may also be stopped or reversed by the controller.

The following describes how the system may be operated to produce a hard book case with tucked corners. The procedure may be automated or semi-automated.

Figure 3:
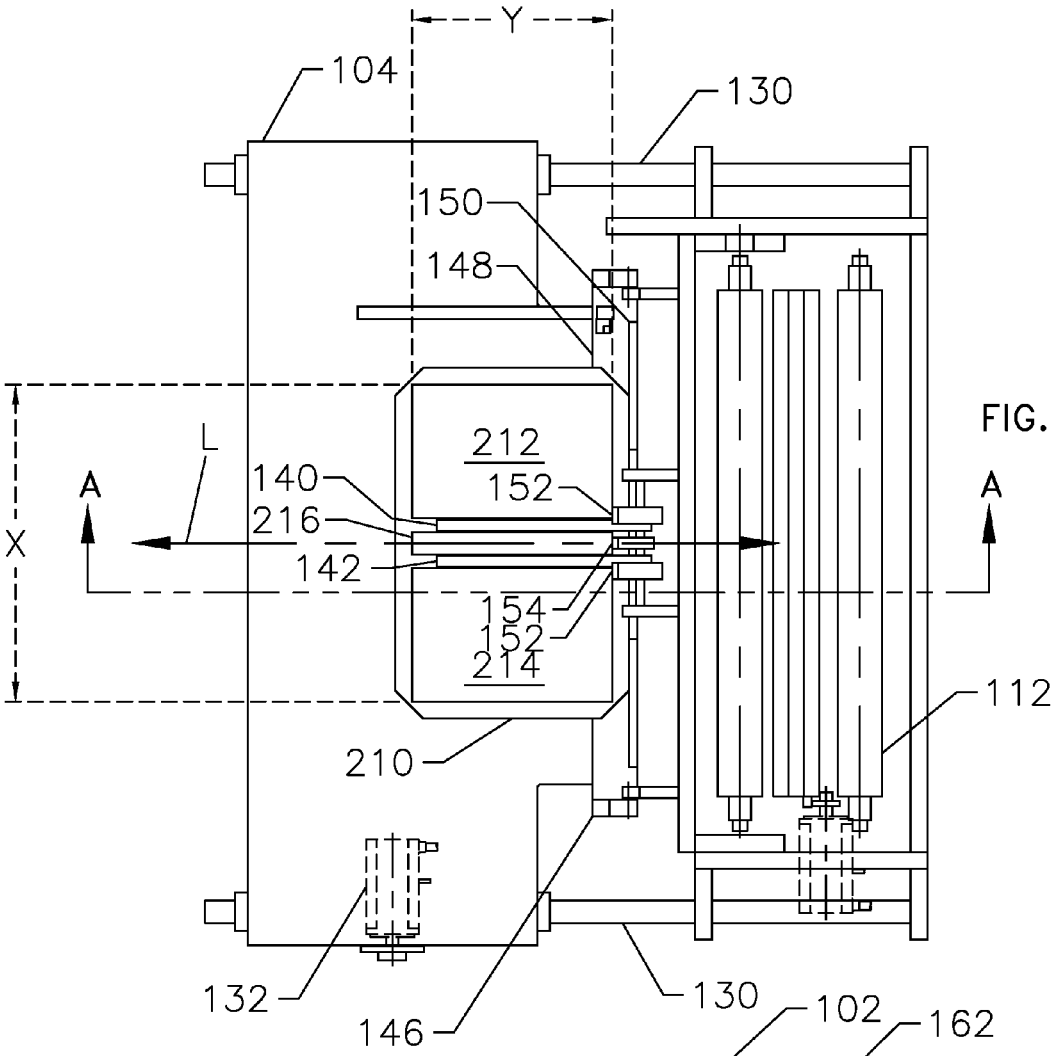
FIGS. 3 and 3A are a schematic plan view and side view along line A-A, respectively, of the embodiment of FIG. 1 showing an unfinished case assembly at a different stage of production.
Figure 3A:
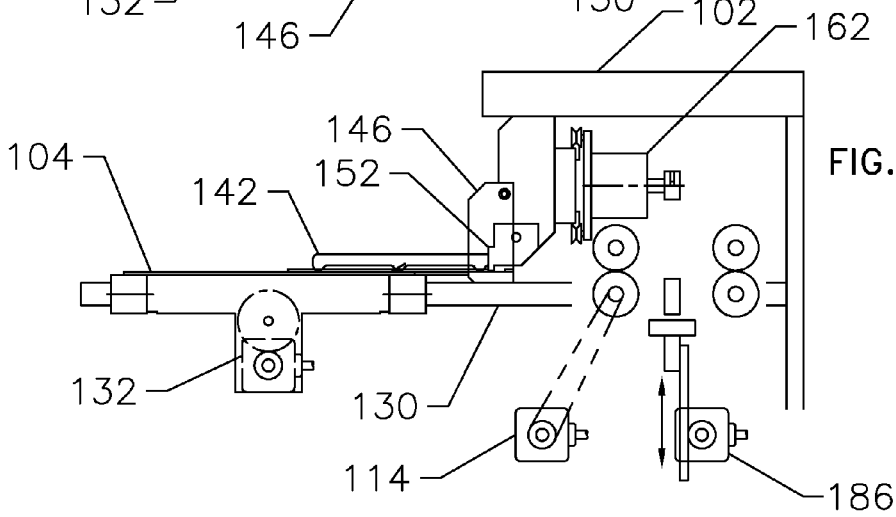

Cover material 210 includes trimmed corners (see FIG. 2) and is laid on feed table 104 with printed side down and glued side up. As shown in FIG. 3, leading edge 220 of cover material 210 is butted up to raised lip 150 to help properly align the cover material. After cover material is placed on feed table 104, gauge blocks 140 and 142 are lowered and the rigid components are placed onto the cover material by the operator to form an unfinished hard book case. Panels 212 and 214 as well as spine 216 are placed in a properly aligned position by butting the leading edges against gauge block lips 152 and laterally against the gauge blocks themselves. Gauge blocks 140 and 142 are laterally slideable by the operator and can be placed in a fixed position that corresponds to the size of the spine or spines chosen for the case. Different width gauge blocks 140 and 142 may be swapped out to provide for different spacing between the rigid panels and the spine.

Figure 4:
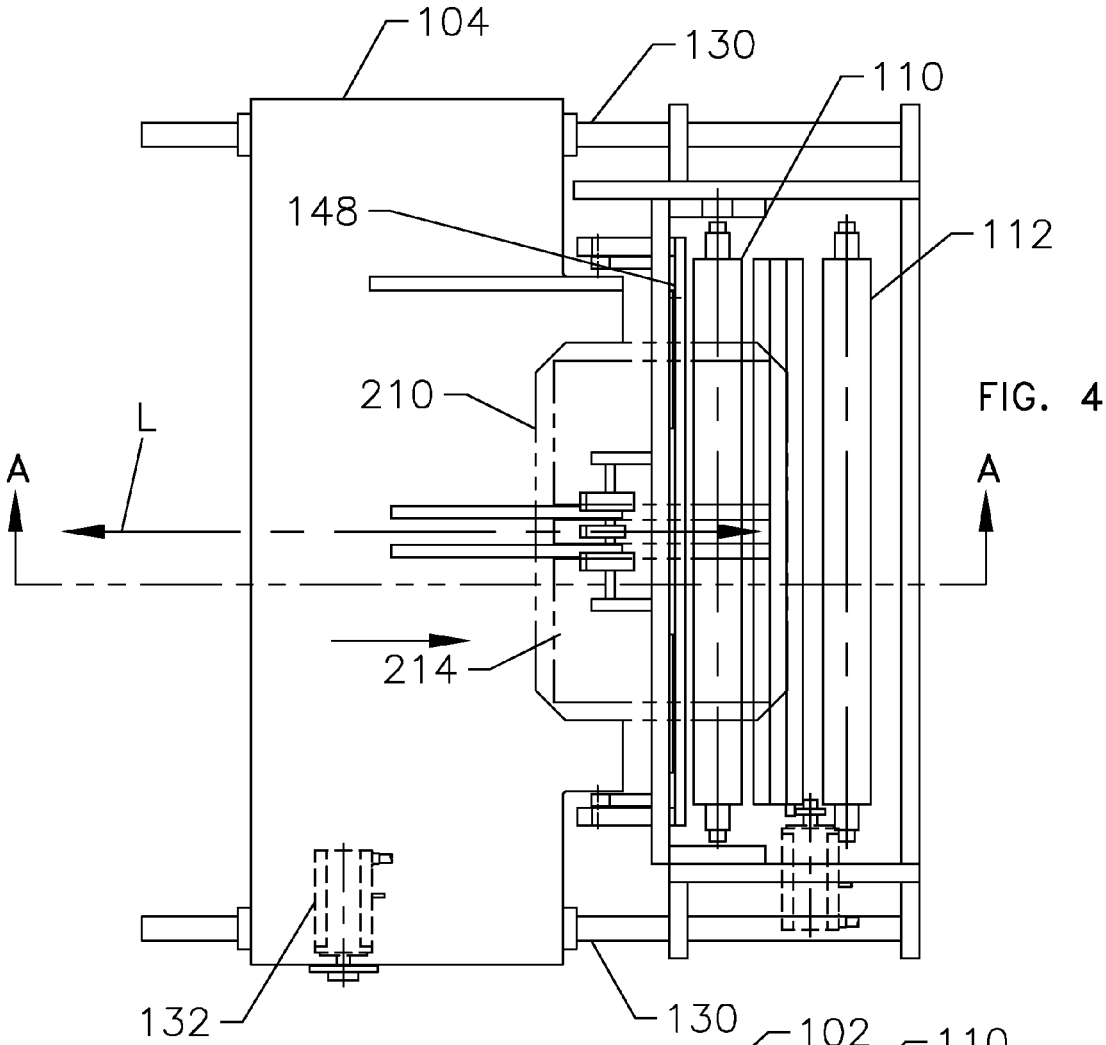
FIGS. 4 and 4A are a schematic plan view and side view along line A-A, respectively, of the embodiment of FIG. 1 showing the unfinished case assembly at a later stage of production.
Figure 4A:
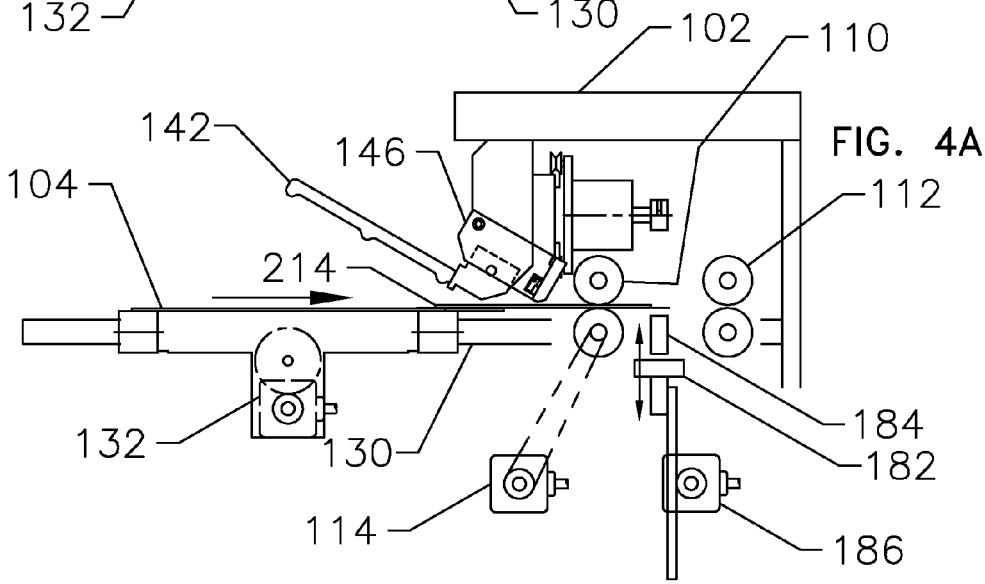
Figure 5:
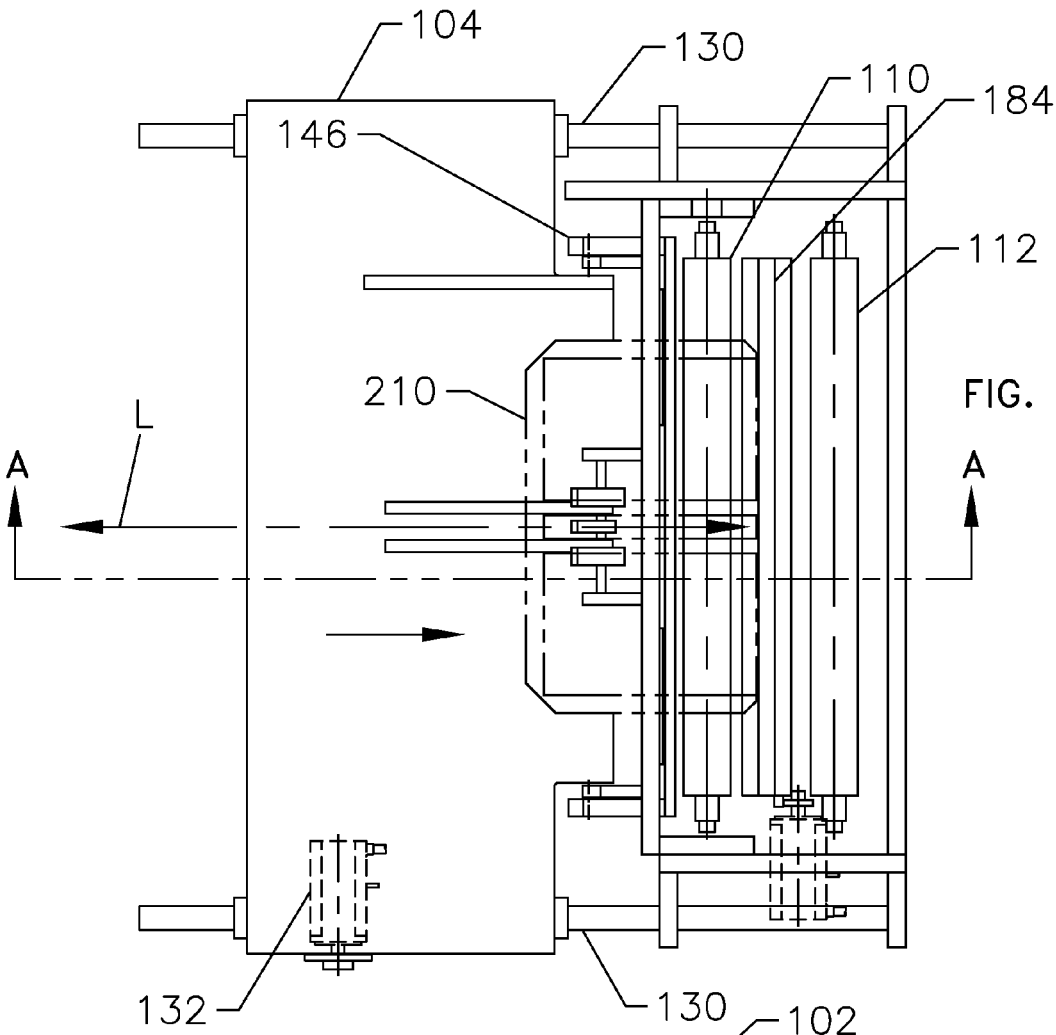
FIGS. 5 and 5A are a schematic plan view and side view along line A-A, respectively, of the embodiment of FIG. 1 showing the unfinished case assembly at a later stage of production.
Figure 5A:
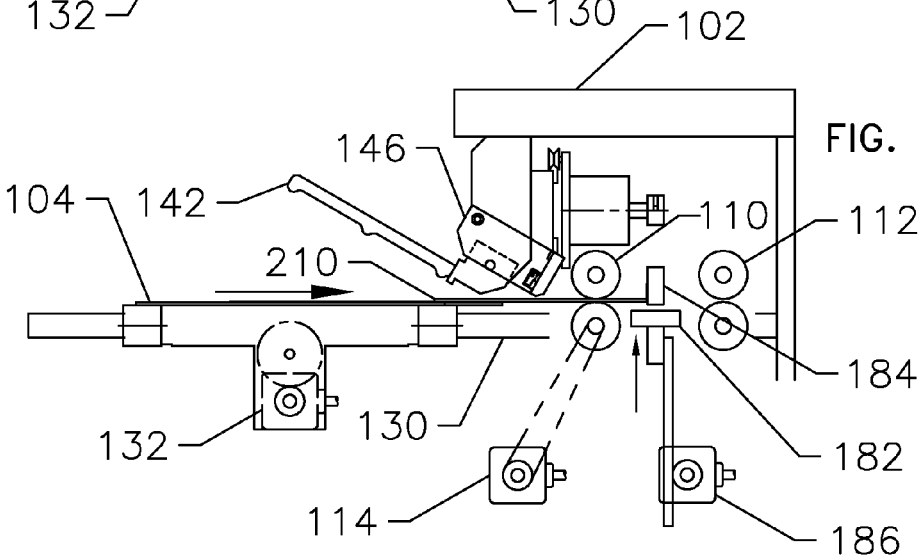
Figure 6:
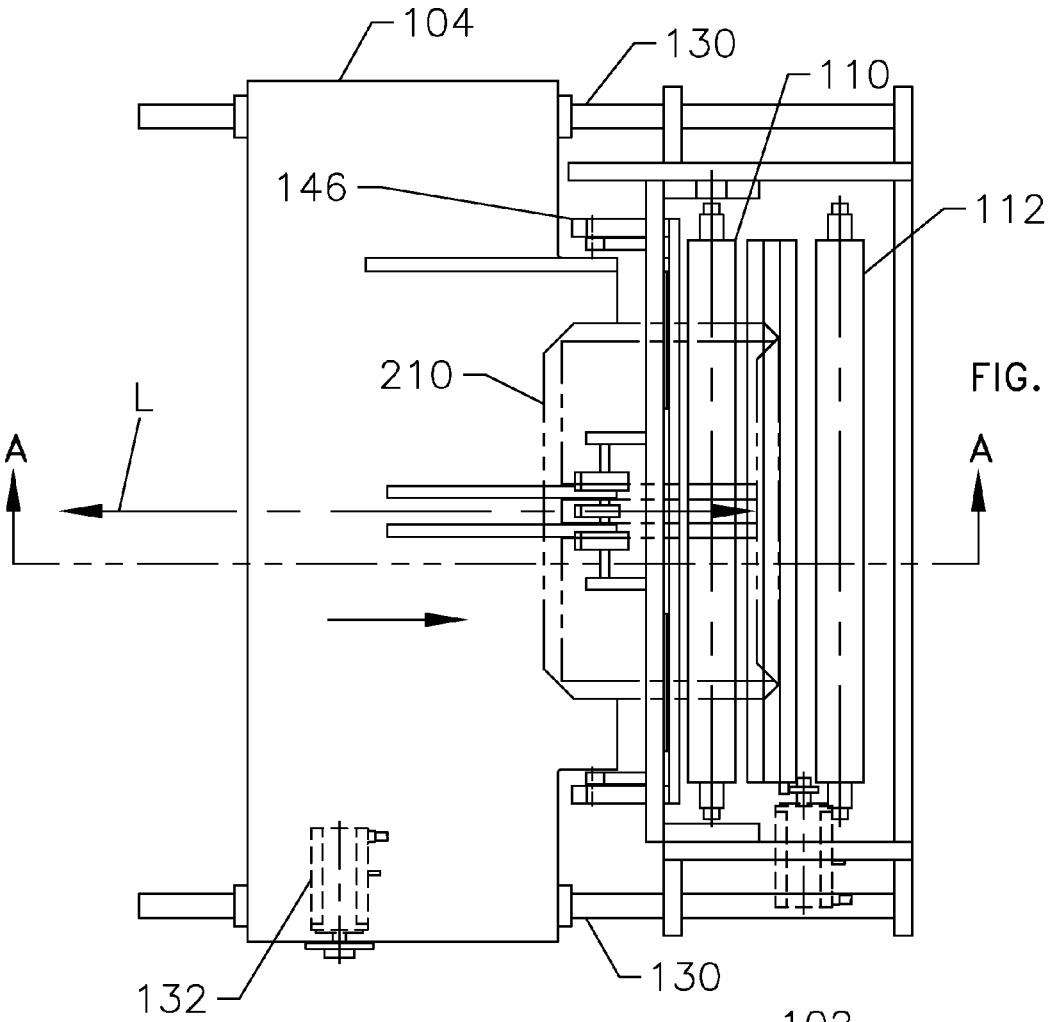
FIGS. 6 and 6A are a schematic plan view and side view along line A-A, respectively, of the embodiment of FIG. 1 showing the unfinished case assembly at a later stage of production.
Figure 6A:
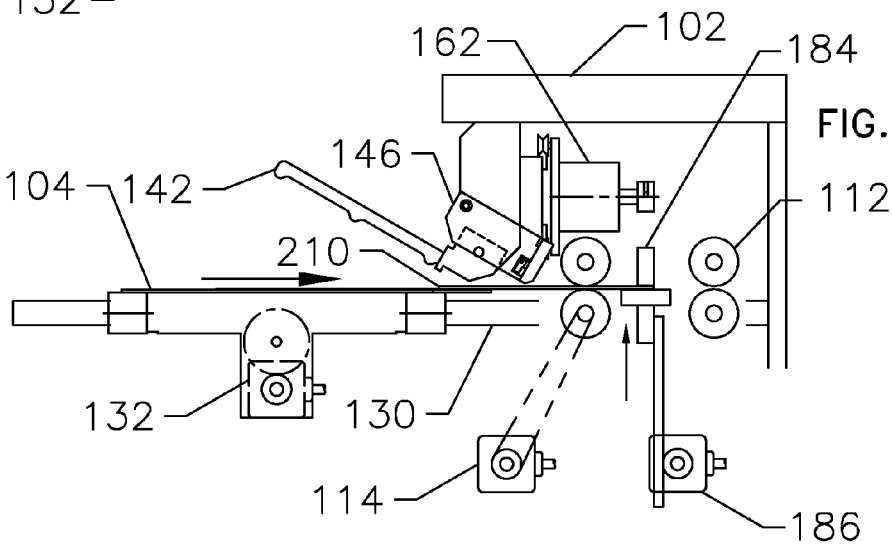
Figure 7:
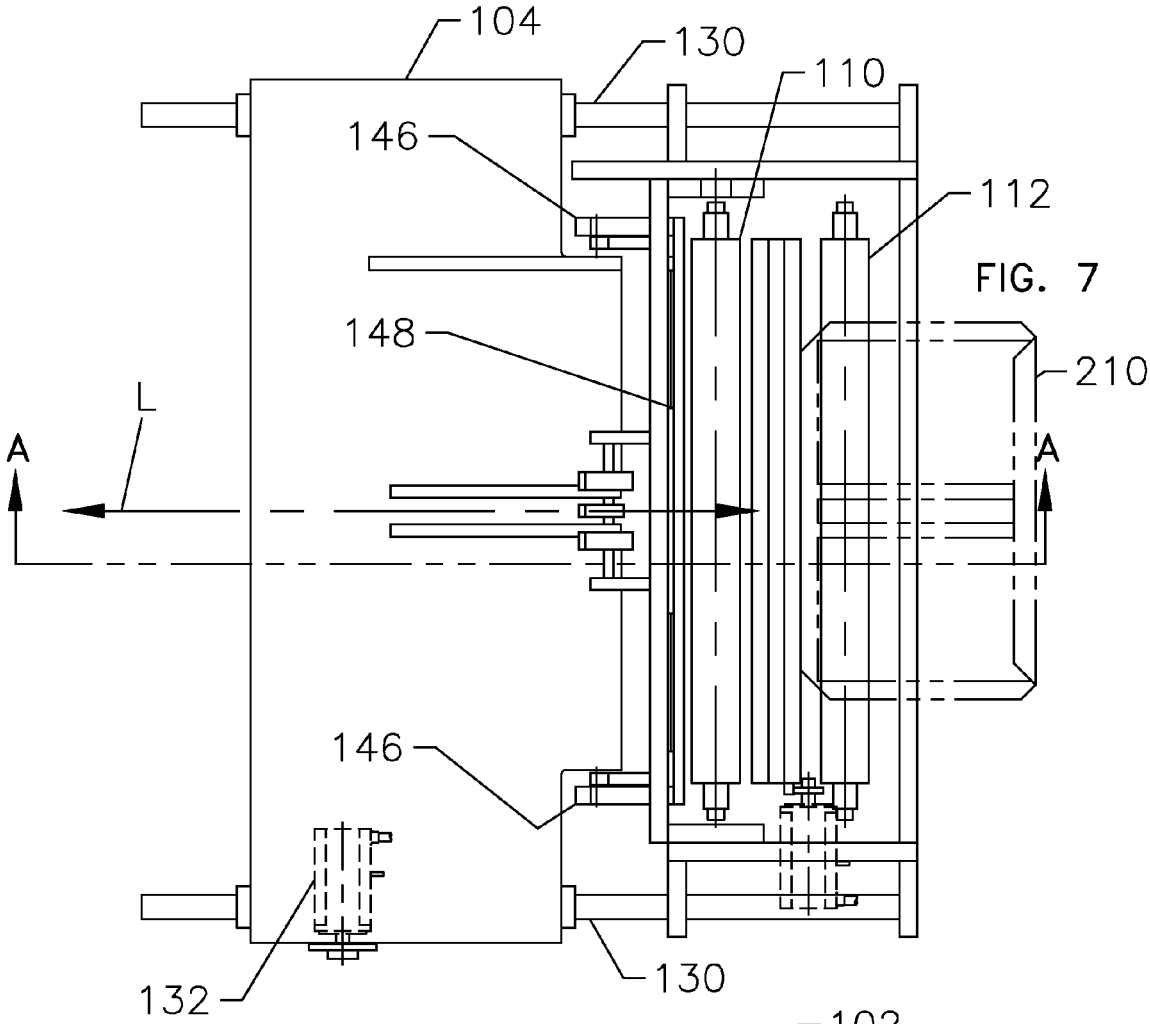
FIGS. 7 and 7A are a schematic plan view and side view along line A-A, respectively, of the embodiment of FIG. 1 showing the unfinished case assembly at a later stage of production.
Figure 7A:
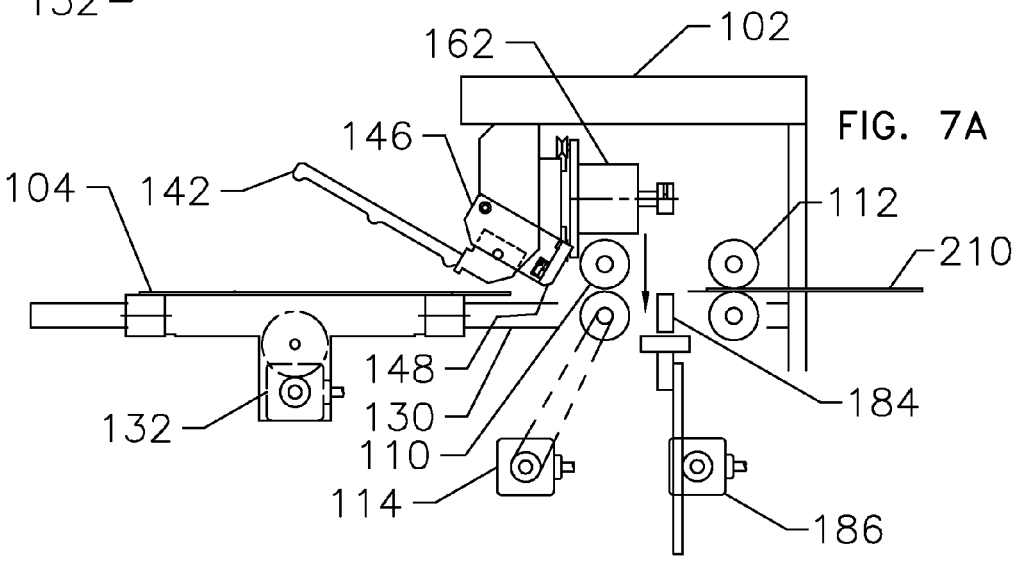
Figure 8:
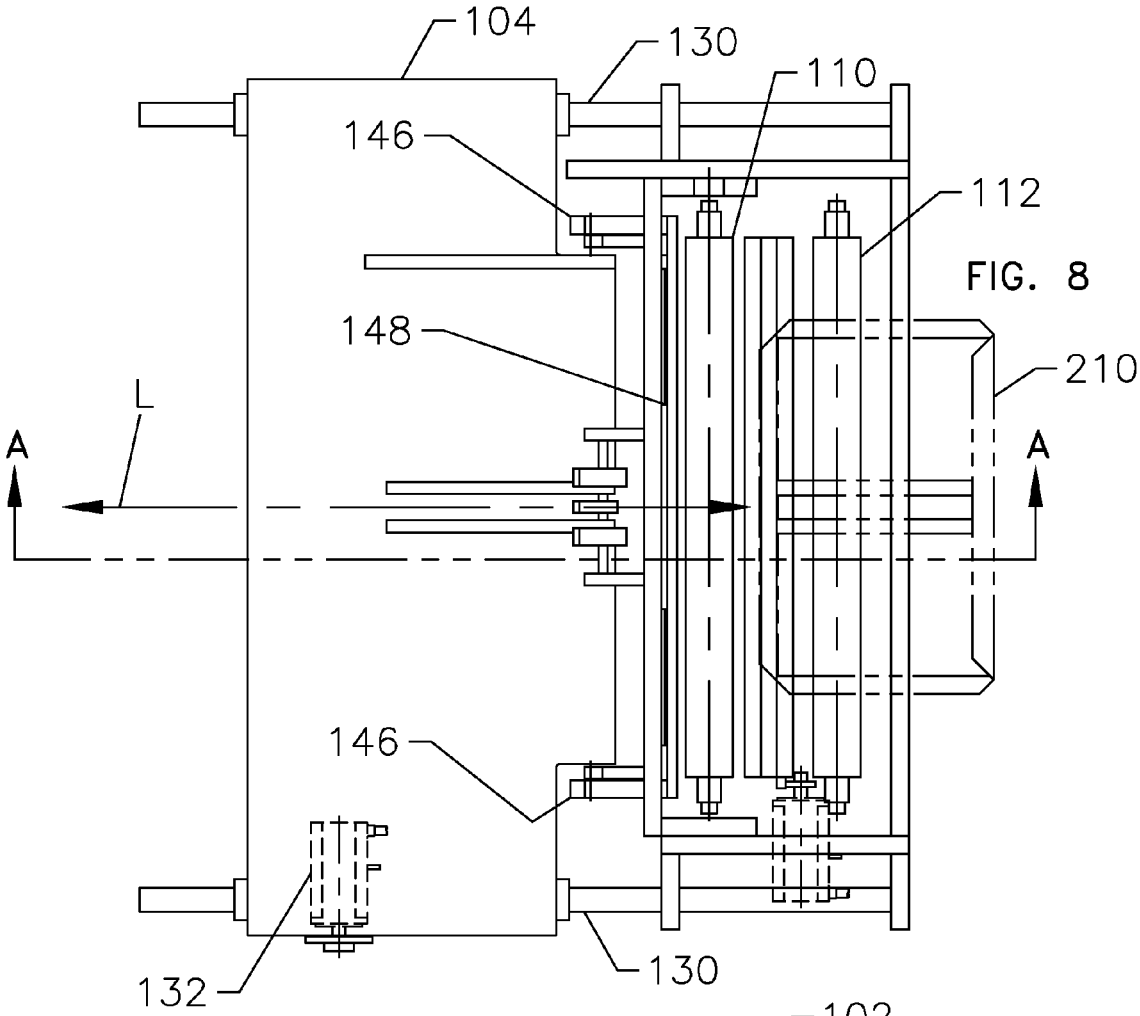
FIGS. 8 and 8A are a schematic plan view and side view along line A-A, respectively, of the embodiment of FIG. 1 showing the unfinished case assembly at a later stage of production.
Figure 8A:
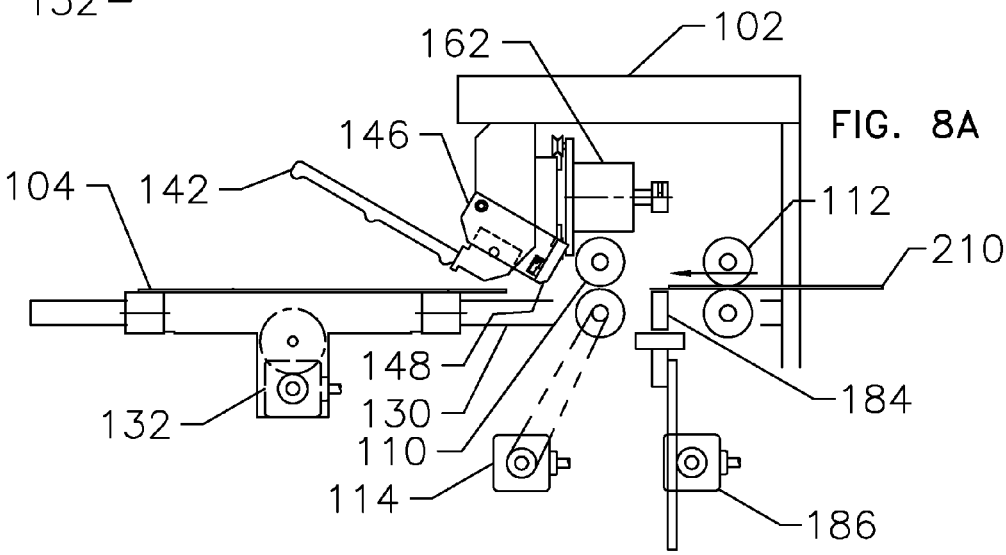

Once panels 212 and 214 and spine 216 have been placed on the glued surface of cover material 210, gauge blocks 140 and 142 as well as swing gate 148 may be pivoted upwardly so that they are removed from the path of travel of the unfinished hard book case. See FIG. 4. Controller 120 activates servo motor 132 and instructs the motor to advance the unfinished assembly the proper distance so that the assembly can be secured by press rolls 110. At this point, the unfinished assembly is handed off from the feed table to the press rolls for further advancement. The controller can retain an index of where the leading edge of the unfinished assembly is located. As shown in FIG. 4A, advancement of the unfinished assembly can be stopped when the leading edge of cover material 210 is positioned over bar 184. The leading edge of rigid panels 212 and 214 as well as the leading edge of spine 216 are stopped just short of bar 184. As shown in FIGS. 5 and 5A, the bar then moves upward, sweeping the cover material with it so that the cover material overhanging the rigid panels is folded upwardly 90 degrees. The case can be pushed against bar 184 by activating rolls 110 to advance the assembly. This can tightly press the cover material against the end of the panel. The bar then moves incrementally upward until the panels of the assembly are aligned with the gap between bar 184 and base 182. Next, as illustrated in FIG. 6, press roll pair 110 is activated by controller 120 to advance the leading edge of the assembly through the gap between bar 184 and base 182. At this point, the overhang portion of the cover material is bent backwards 180 degrees. The leading edge is then advanced through roll pair 112 and the folded portion of the cover material is pressed into contact with the top surface of the rigid panel and spine to permanently fix the cover material to the edge of the rigid panel. Advancement of the unfinished assembly stops when the trailing edge of the assembly is clear to allow bar 184 to be lowered. See FIG. 7. Then the rollers reverse direction so that the unfinished assembly is positioned above fold bar 184 as shown in FIG. 8A.

Figure 9:
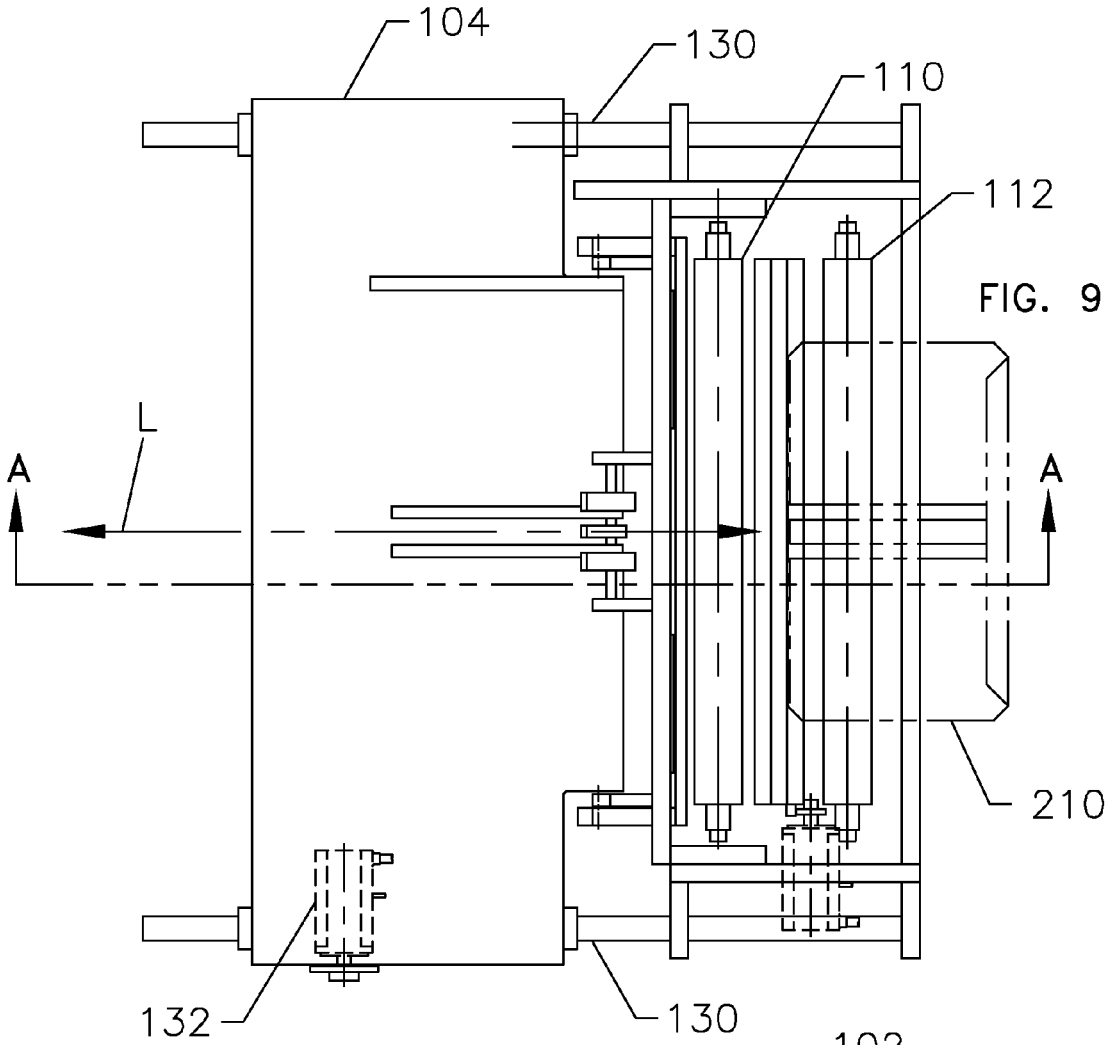
FIGS. 9 and 9A are a schematic plan view and side view along line A-A, respectively, of the embodiment of FIG. 1 showing the unfinished case assembly at a later stage of production.
Figure 9A:
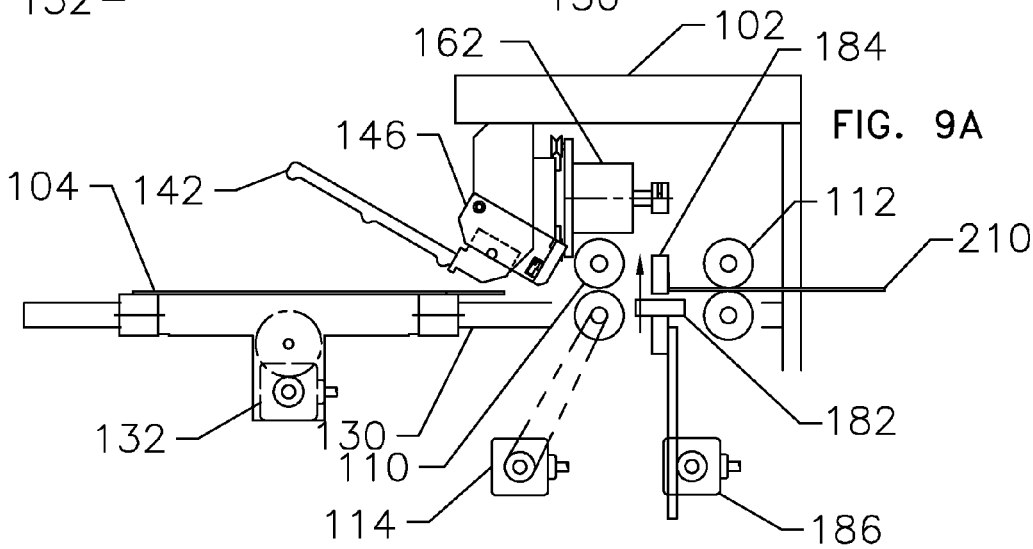
Figure 10:
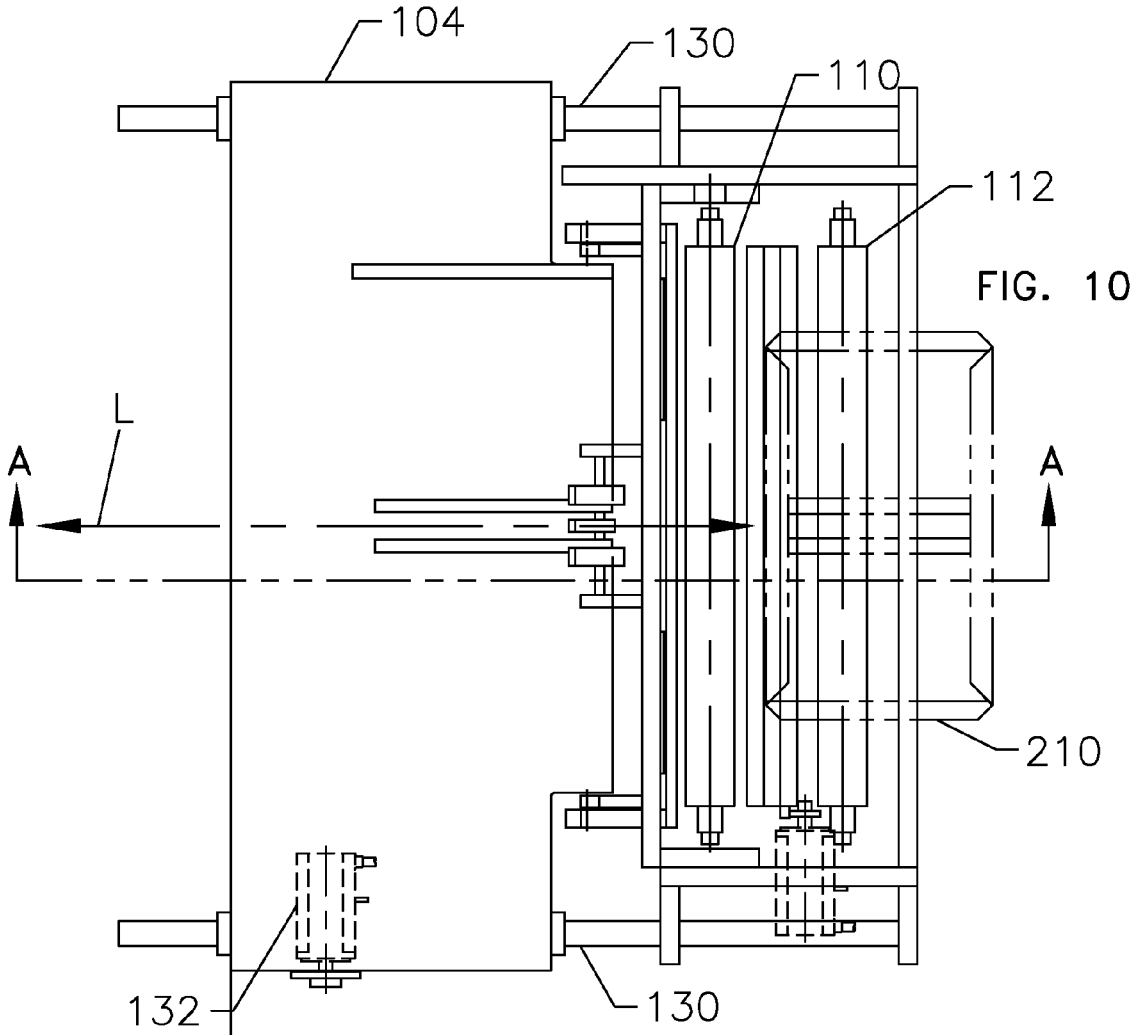
FIGS. 10 and 10A are a schematic plan view and side view along line A-A, respectively, of the embodiment of FIG. 1 showing the unfinished case assembly at a later stage of production.
Figure 10A:
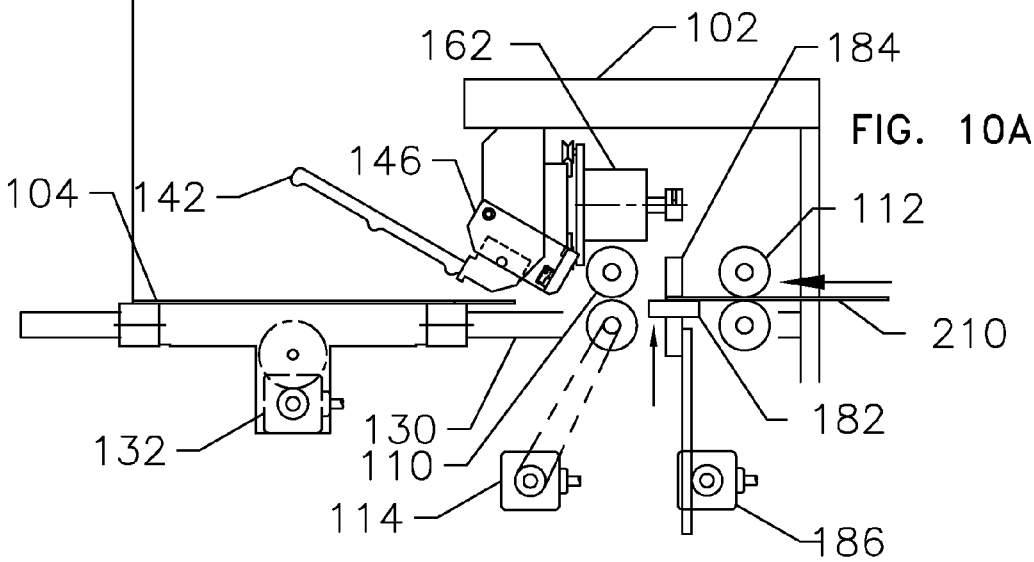
Figure 11:
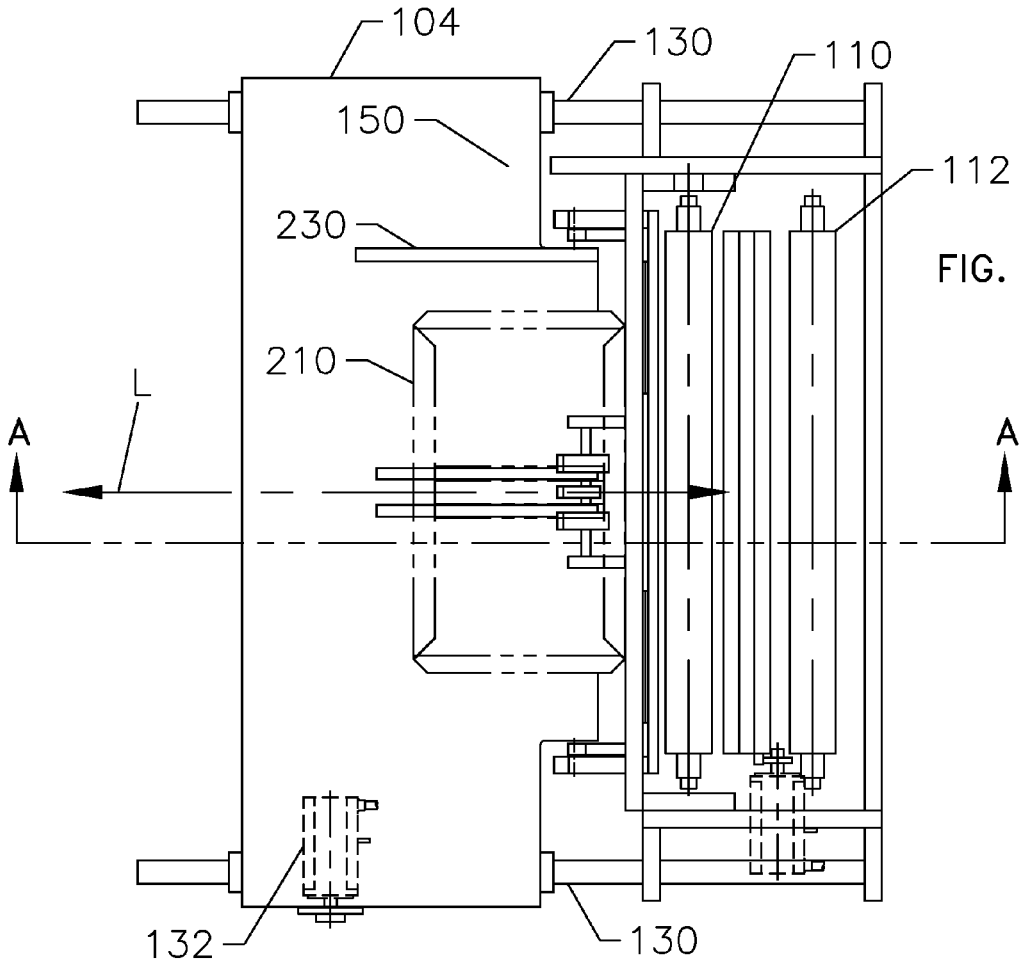
FIGS. 11 and 11A are a schematic plan view and side view along line A-A, respectively, of the embodiment of FIG. 1 showing the unfinished case assembly at a later stage of production.
Figure 11A:
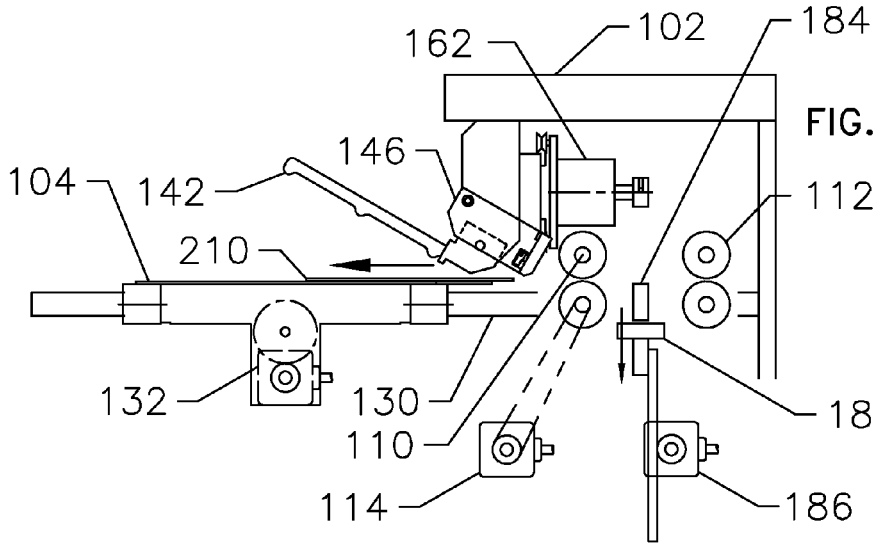

In FIGS. 9 and 9A folding device 106 is raised to bend the trailing edge of the cover material to about 90 degrees. Rolls 112 can be activated to push the trailing edge against bar 184 to provide a tight wrap around the edge of the panel. The folding device is then raised incrementally more and the trailing edge is pushed back through the gap by roller pair 112. As shown in FIGS. 10 and 10A cover material is folded back about 180 degrees as the unfinished assembly returns through the gap from right to left. The assembly continues its motion along the first axis to roll pair 110 that compresses and fixes the cover material to the rigid panels 212 and 214. Motion from right to left (from the vantage point of FIG. 11A) continues until the unfinished assembly is released by the rollers onto the feed table. By this point, two opposed edges of the cover material have been folded and pressed onto the rigid panels and spine.

Figures 12, 12A, 12B:
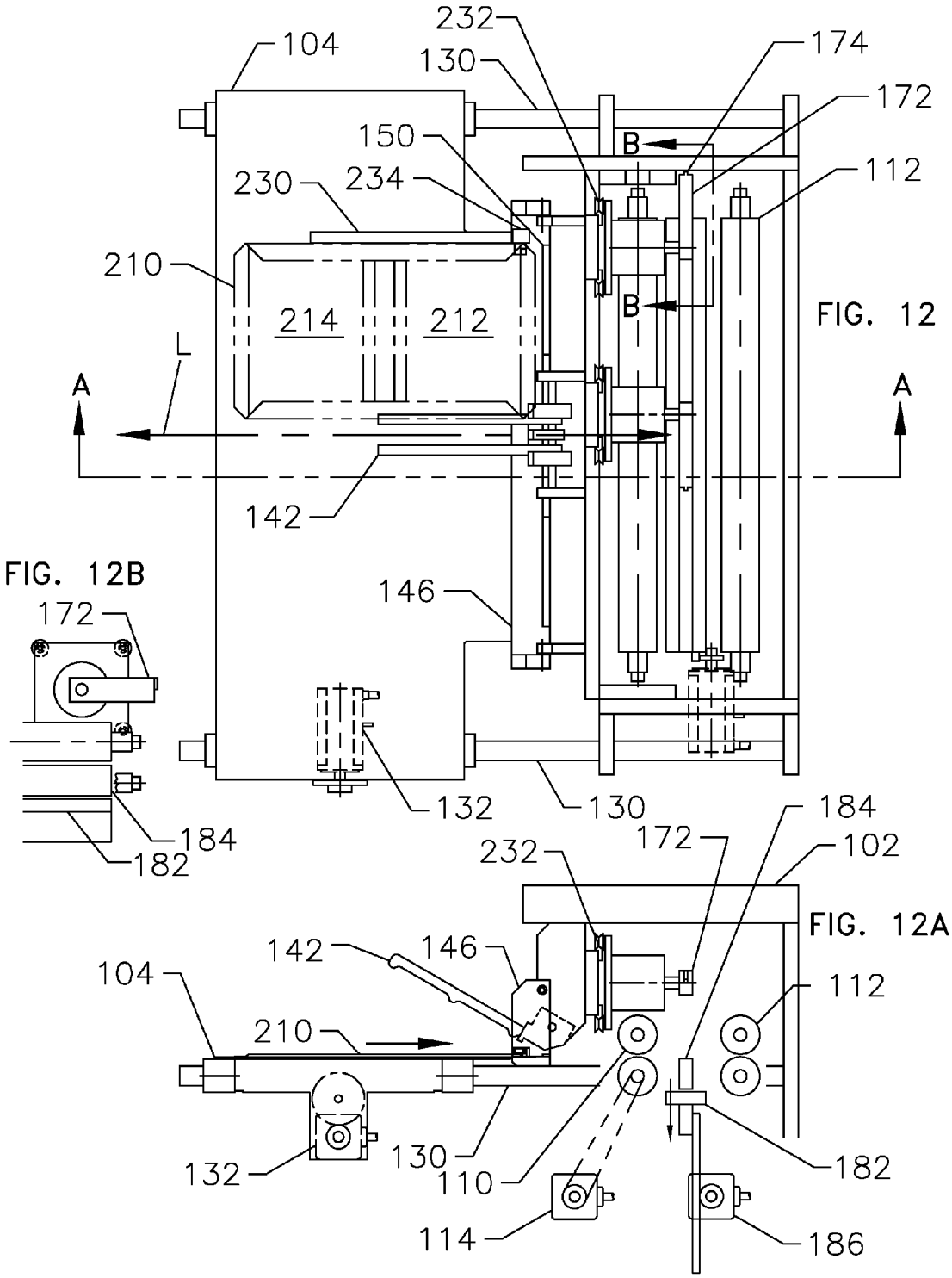
FIGS. 12, 12A and 12B are, respectively, a schematic plan view, a side view along line A-A, and a side view along line B-B, showing the unfinished case assembly at a later stage of production.
Figures 18, 18A, 18B:
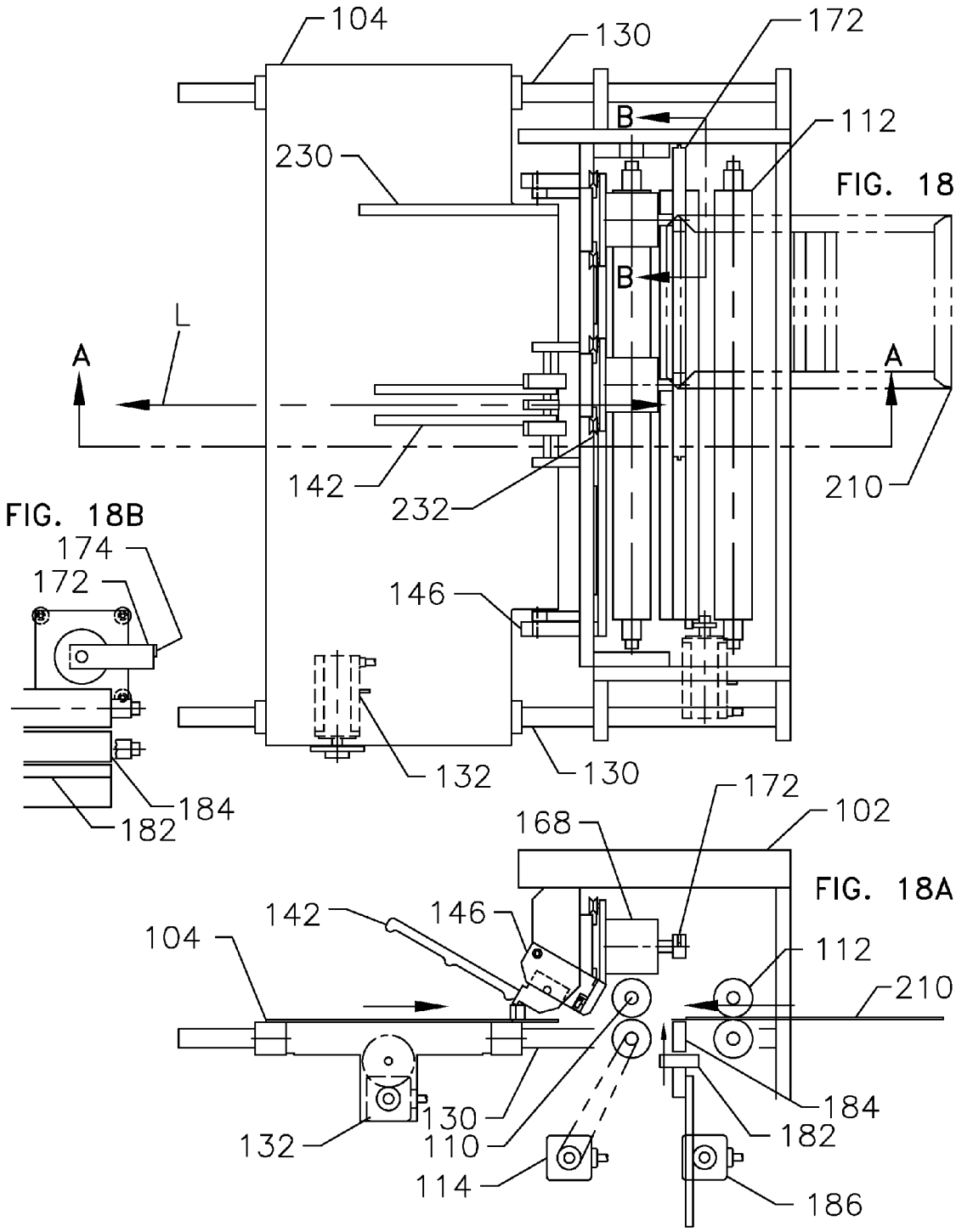
FIGS. 18, 18A and 18B are, respectively, a schematic plan view, a side view along line A-A, and a side view along line B-B, showing the unfinished case assembly at a later stage of production.
Figures 20, 20A, 20B:
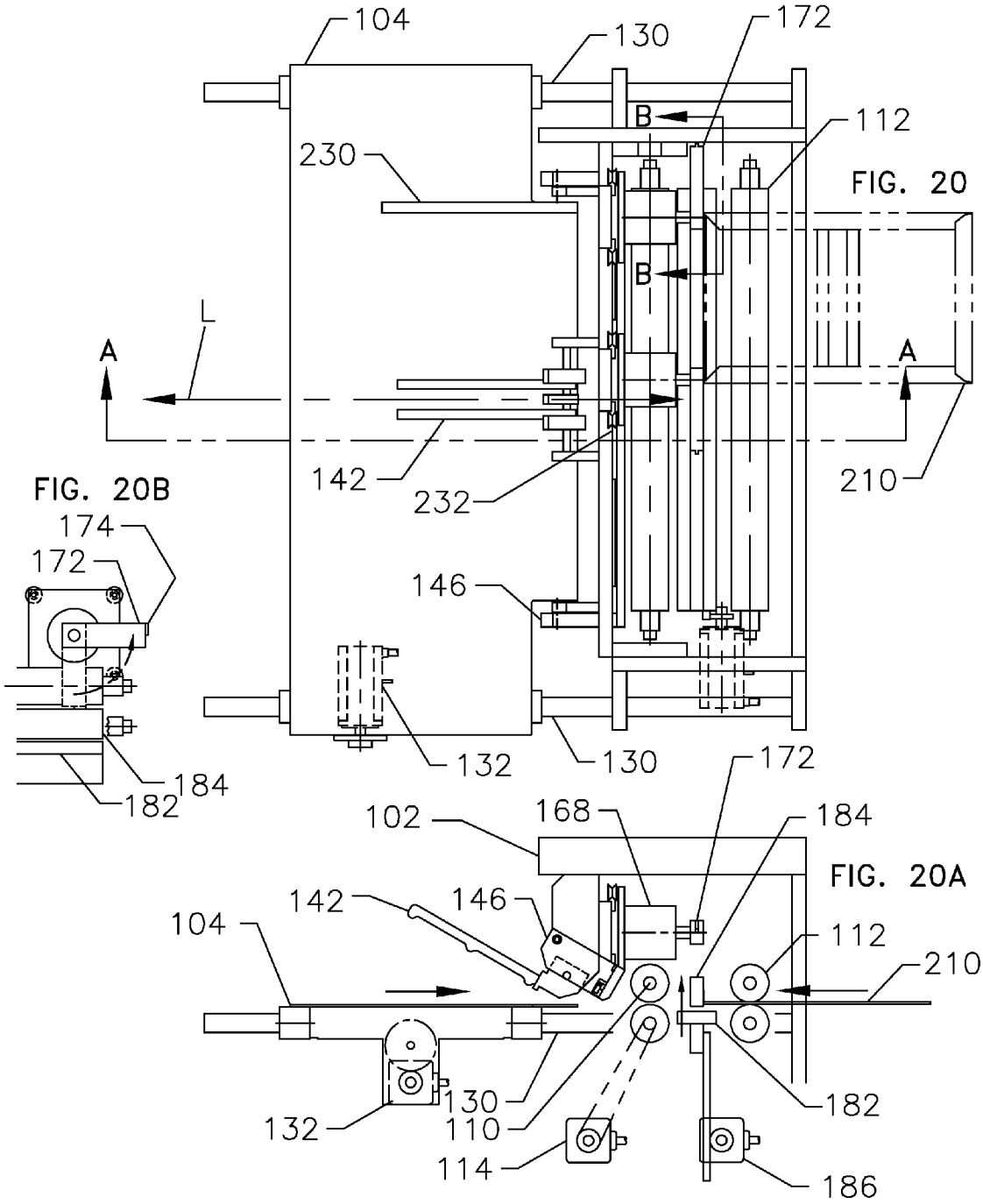
FIGS. 20, 20A and 20B are, respectively, a schematic plan view, a side view along line A-A, and a side view along line B-B, showing the unfinished case assembly at a later stage of production.
Figures 21, 21A, 21B:
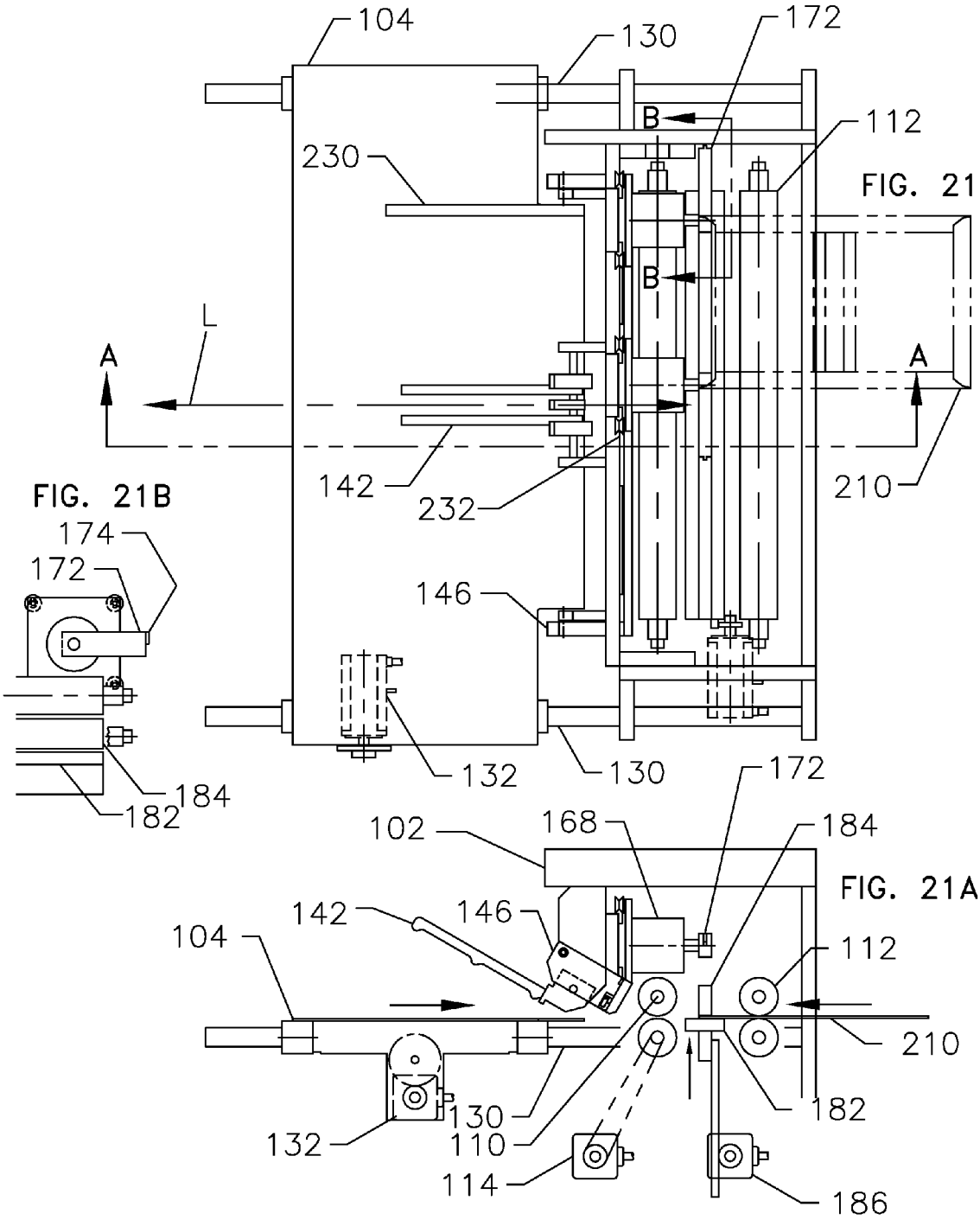
FIGS. 21, 21A and 21B are, respectively, a schematic plan view, a side view along line A-A, and a side view along line B-B, showing the unfinished case assembly at a later stage of production.

The unfinished assembly may now be available on the feed table where it can be rotated 90 degrees to prepare for tucking and/or folding of the two unfinished edges. The assembly may be rotated by hand or by machine. As illustrated herein, the assembly can be rotated by hand and placed back on feed table 104 as shown in FIG. 12. A finished edge of the assembly is pressed against guide 230 on feed table 104 and an unfinished edge is butted up against side fold front stop 234. In this manner, the initial position of this edge is fixed and left tucking assembly 160 can be laterally aligned along rail 232 in a position where rotating tuck arm can be aligned with the finished edge. Right tucking assembly 162 may be aligned with the opposing finished edge of the assembly by sliding assembly 162 along rail 232 until it is properly positioned. This can be facilitated by the use of guides (unshown) connected to each tucking assembly. The partially finished assembly can be placed in the guides and the right tucking assembly 162 can be moved inwardly until the guide makes contact with the finished edge of the partially finished assembly. When contact is made, the tucking assembly can be locked into place using, for example, a spring loaded set screw.

The leading edge of leading panel 212 can be butted up against swing arm 148 for accurate initial positioning along the axis of travel. Controller 120 can use this position as a starting point and can track the position of the leading edge throughout the rest of the process.

Figures 22, 22A, 22B, 22C, 22D, 22E:
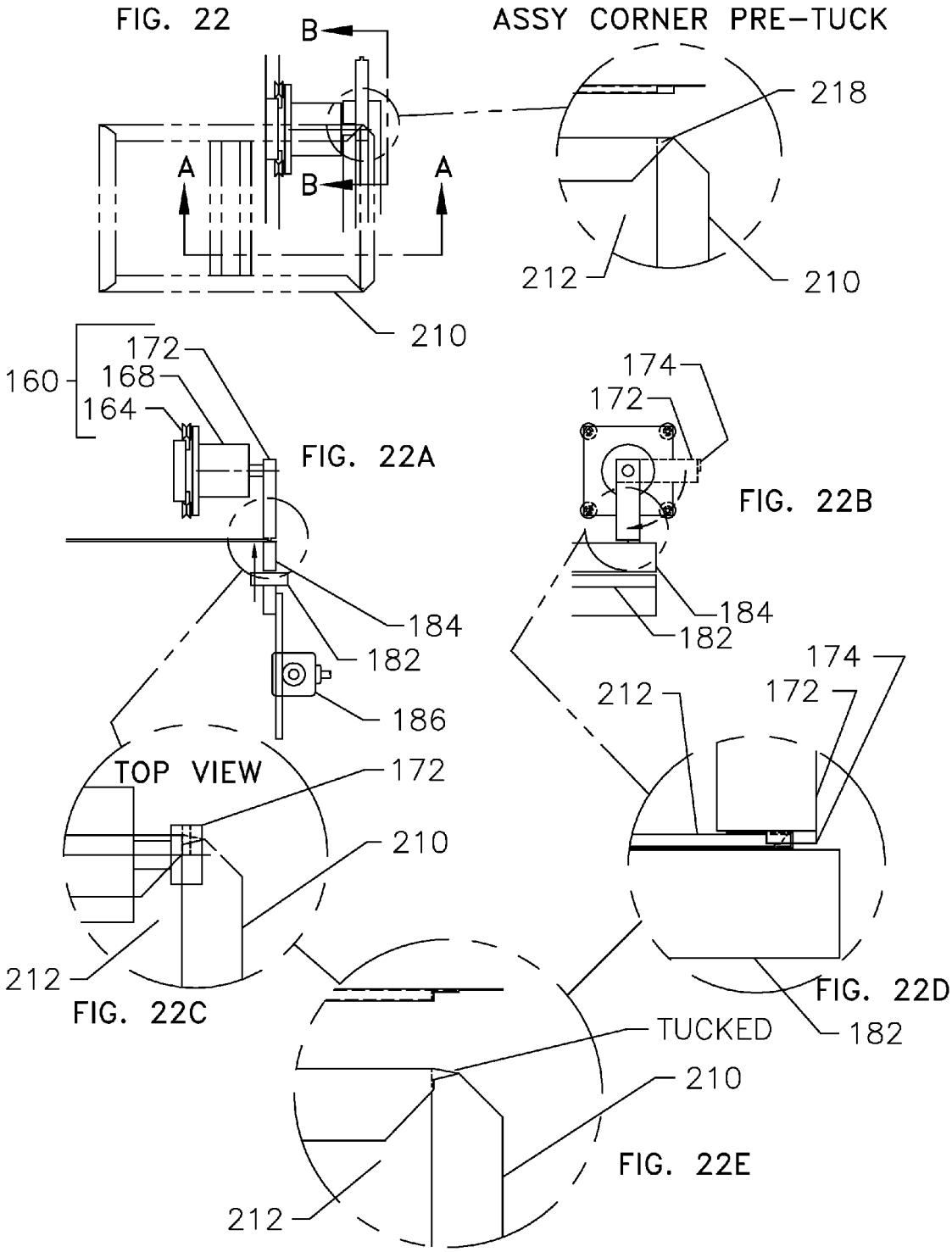
FIG. 22 illustrates an untucked corner of an unfinished case assembly.
FIG. 22A provides a side view along line A-A of a corner being tucked.
FIG. 22B provides a side view along line B-B of a corner being tucked.
FIG. 22C provides an enlarged plan view of a corner being tucked.
FIG. 22D provides an enlarged side view of a corner being tucked.
FIG. 22E provides a plan view of a finished tucked corner.

For tucking (from the position shown in FIG. 12), the unfinished assembly can be advanced along axis of travel L until the leading edge of panel 212 is positioned over bar 184. See FIG. 13 At this point, the edge of panel 212 will be aligned with the edge of rotary tuck arm 172 so that when tuck arm 172 is rotated downwardly it is properly aligned for tucking cover material against the edge of panel 212. Prior to tucking, the corner will appear as shown in FIG. 22. As shown in FIG. 13A, bar 184 can then be raised to a point where it can support the leading edge of panel 212, and can provide a stable platform against which the tuck arm can act. At this point, rotary tuck arm 172 of assemblies 160 and 162 can be activated to tuck the leading edge of cover material 210. FIG. 13B shows a view of a tucking assembly taken along line B-B of FIG. 13. As illustrated in FIGS. 14, 14A and 14B tuck arm 172 rotates downwardly and swings in from the outside on each side (from direction of the finished edge toward the middle of panel 212.) As shown in expanded views 22A, 22B, 22C and 22D, the tip 174 of tuck arm 172 contacts the cover material and compresses the folded over portion 218 of the cover material with the unfolded portion at a point just past the edge of rigid panel 212. Tuck arm tip 174 extends from the end of tuck arm 172 by a distance about equal to the thickness of the rigid panel. These dimensions can help with making a more precise tuck as the untipped portion of arm 172 presses down on the previously folded cover material and panel while tip 174 tightly compresses cover material against cover material. As the contacting sides of the two portions of cover material are both glued, the portions are securely joined together, forming a neat tuck along the edge of panel 212. A portion of cover material is also pressed tightly against the edge of the panel. The tuck arm 212 can then be retracted and the tuck will be completed. See FIG. 22E.

As shown in FIGS. 15 and 15B and 15C, the leading edge can now be folded in a manner similar or identical to that previously shown in FIGS. 5 and 6. After the leading edge of cover material 210 is folded over, two complete corners have been produced on the leading edge. The unfinished assembly may now be advanced to the right (as viewed in FIG. 16A) to a point where the trailing edge of panel 214 can be tucked and folded.

The controller can predetermine the width of the finished assembly (from leading edge of panel 212 to trailing edge of panel 214) using any of the techniques described herein. For example, the width may be input by the operator, may be determined by a measuring device, may be detected by a photo cell or may be determined by detecting a change in the positional error or the torque of servo motor 114 when the edge of a panel contacts bar 184. The width may also be recalled from a previously run process producing a case of the same dimensions.

Using the predetermined width of the finished hard book case, controller 120 instructs roll pair 112 to transport the unfinished assembly from left to right along axis L, stopping after the assembly is past bar 184. See FIG. 17. Bar 184 may then be lowered and the case may reverse direction and be stopped at the point where the trailing edge of panel 214 is above bar 184 and is aligned for tucking with rotary tuck arms 172 of tucking assemblies 160 and 162. See FIGS. 18, 19 and 20. This can be achieved by monitoring the position of the leading edge of the assembly and by knowing the distance between the leading edge and the trailing edge of the finished assembly. This distance is substantially the same as the distance from the leading edge of panel 212 to the trailing edge of panel 214.

The trailing edge can be tucked and/or folded in a manner similar to that used for the leading edge and the final fold of the assembly is made by passing the assembly back through the gap between bar 184 and base 182 (FIG. 21) and then through roll pair 110 (from right to left looking at FIG. 15A). Once this final edge has been folded and pressed, the now finished assembly can reverse direction again and be ejected from left to right through roll pair 112. Alternatively, the finished assembly can continue from right to left and be ejected back onto feed table 104 through rolls 110.

While corners are being tucked and the final two edges being folded, the operator can be placing the next cover material and rigid panels on the feed table in preparation for the next cycle, assuming the finished assembly is not being ejected back onto feed table 104. In this manner, differently dimensioned custom finished hard book cases with or without tucked corners can be produced at rates greater than about 3 per minute. During the procedure, the case need only be transported along a single axis L and the entire apparatus may consume a footprint of less than 20 square feet.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

What is claimed is:

1. An apparatus for producing cases for hard cover books, the apparatus comprising:

a feed table for transporting an unfinished hard book case along a first axis;

a pair of press rolls for transporting the case along the first axis;

a fold bar having a first edge constructed and arranged to fold a leading edge of the case and having a second edge constructed and arranged to fold a trailing edge of the case; and a controller in communication with the feed table, the press rolls, and the fold bar, wherein the controller can track the position of the assembly along the first axis.

2. The apparatus of claim 1 comprising a user interface for inputting a dimension of the hard case.

3. The apparatus of claim 1 comprising a measuring device for determining at least one dimension of the hard case.

4. The apparatus of claim 3 wherein the measuring device comprises a radial arm.

5. The apparatus of claim 3 wherein the measuring device comprises a photo cell.

6. The apparatus of claim 1 comprising a torque detector and/or a position error detector for determining a dimension of the hard case.

7. The apparatus of claim 1, wherein the fold bar is constructed and arranged to fold a leading edge and a trailing edge of a second unfinished hard book case of a different size without an operator making adjustments to the feed table, press rolls, or fold bar.

8. The apparatus of claim 1, wherein the feed table is constructed and arranged to transport a second unfinished hard book case of a different size along the first axis without an operator making adjustments to the feed table, press rolls, or fold bar.

9. The apparatus of claim 1, wherein the fold bar is constructed and arranged to press the cover material into the leading edge of the case.

10. The apparatus of claim 1, wherein the press rolls are constructed and arranged to transport a second unfinished hard book case of a different size along the first axis without an operator making adjustments to the feed table, press rolls, or fold bar.

11. The apparatus of claim 1 comprising a swing gate including a forward stop for positioning the leading edge of a case panel.

12. The apparatus of claim 1 comprising at least one gauge block for positioning one or more rigid components on the feed table.

13. The apparatus of claim 1, wherein the first axis is horizontal.

14. The apparatus of claim 1, wherein the feed table further comprises an upper surface thereon, such surface defining a first plane including the first axis and wherein the fold bar is moveable in a direction perpendicular to the first plane.

15. The apparatus of claim 1, wherein the fold bar is non-rotating.

16. The apparatus of claim 1, further comprising at least one corner tucker constructed and arranged to tuck at least one corner.

* * * * *